US010933664B2

(12) United States Patent
Komuro

(10) Patent No.: US 10,933,664 B2
(45) Date of Patent: Mar. 2, 2021

(54) RECORDING APPARATUS

(71) Applicant: SEIKO EPSON CORPORATION, Tokyo (JP)

(72) Inventor: Shintaro Komuro, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 18 days.

(21) Appl. No.: 16/420,349

(22) Filed: May 23, 2019

(65) Prior Publication Data

US 2019/0358973 A1 Nov. 28, 2019

(30) Foreign Application Priority Data

May 25, 2018 (JP) ..... JP2018-100738

(51) Int. Cl.

| | |
|---|---|
| ***B41J 3/60*** | (2006.01) |
| ***B41J 13/00*** | (2006.01) |
| ***B65H 5/06*** | (2006.01) |
| ***B41J 13/02*** | (2006.01) |

(52) U.S. Cl.

CPC ..... *B41J 13/0045* (2013.01); *B41J 3/60* (2013.01); *B41J 13/009* (2013.01); *B41J 13/02* (2013.01); *B65H 5/062* (2013.01)

(58) Field of Classification Search

CPC .... B41J 13/009; B41J 13/025; B41J 13/0045; B41J 3/60; B41J 3/62

See application file for complete search history.

(56) References Cited

U.S. PATENT DOCUMENTS

| | | | | |
|---|---|---|---|---|
| 8,366,099 | B2 * | 2/2013 | Cook | B65H 5/062 271/186 |
| 2013/0001864 | A1 * | 1/2013 | Ota | H04N 1/00745 271/109 |
| 2014/0063108 | A1 * | 3/2014 | Iijima | B41J 13/0009 347/16 |
| 2015/0273892 | A1 * | 10/2015 | Tanjo | B41J 29/02 347/104 |
| 2015/0284202 | A1 * | 10/2015 | Asano | B65H 29/125 271/3.19 |
| 2016/0288546 | A1 | 10/2016 | Mizutani et al. | |

FOREIGN PATENT DOCUMENTS

| | | |
|---|---|---|
| JP | 2014-227293 A | 12/2014 |
| JP | 2016-193555 A | 11/2016 |

* cited by examiner

*Primary Examiner* — Scott A Richmond
(74) *Attorney, Agent, or Firm* — Workman Nydegger

(57) ABSTRACT

A recording apparatus includes a recording unit, a first transport path through which a medium is transported in a first direction during recording, a second transport path through which the medium after the recording is transported along a path that is different from the first transport path in a second direction, a discharge roller pair that is disposed at a downstream position of the recording unit and that is configured to be displaced between a nipping position and a separation position, and a flap that is disposed downstream of the recording unit. When the following medium is transported on the first transport path, the preceding medium is transported on the second transport path, and the respective media are disposed at a position of the discharge roller pair at the same time, the discharge roller pair is disposed at the separation position, and the flap is disposed at an advanced position.

8 Claims, 9 Drawing Sheets

RECORDING APPARATUS

The present application is based on, and claims priority from JP Application Serial Number 2018-100738, filed May, 25, 2018, the disclosure of which is hereby incorporated by reference herein in its entirety.

BACKGROUND

1. Technical Field

The present disclosure relates to a recording apparatus including a recording unit that performs recording on a medium and a reverse path for reversing the medium after the recording.

2. Related Art

This type of recording apparatus includes, for example, a transport unit that transports the medium and a recording head that discharges an ink (an example of liquid) onto the medium to perform printing (for example, JP-A-2016-193555 and JP-A-2014-227293).

The recording apparatus disclosed in JP-A-2016-193555 and JP-A-2014-227293 includes a reverse path (a second transport path) that reversely transports and inverts the medium after printing is performed on a front surface of the medium transported along a transport path (a first transport path) for performing duplex printing on the medium.

The recording apparatus disclosed in JP-A-2016-193555 includes a printing mechanism that prints an image by discharging an ink to a medium such as a paper sheet (a sheet), a first transport path through which the medium on which the image is printed by the printing mechanism passes in a transport direction, and a second transport path through which the medium transported in a reverse transport direction passes so that the front side and the rear side of the medium is reversed and which returns the reversed medium to the first transport path. A switchback operation of returning the medium having a printed first surface (the front surface) to the first transport path through the second transport path is performed and printing is performed on a second surface of the reversed medium returning to the first transport path, so that the duplex printing is performed.

In the recording apparatus, since a circulation transport path is formed by the first transport path and the second transport path, the medium is continuously fed, printing is performed on a first surface of the preceding medium, and printing is performed on a first surface of the following medium. Next, when printing is performed on a second surface of the preceding medium reversed and re-fed through the second transport path, and the preceding medium, which is completely duplex-printed, is discharged, subsequently, printing is performed on a second surface of the following medium. Since the duplex printing is performed by continuously circulating and transporting a plurality of media, a standby time is small, and high-speed printing can be achieved. However, in the recording apparatus disclosed in JP-A-2016-193555, until the switchback operation of reversely transporting the discharged preceding medium to the second transport path by reversing a discharge roller pair is terminated after the printing is terminated, while the following medium transported by forward rotation of the discharge roller pair is printed, a standby time may occur during which the printing is temporarily stopped and waits.

For example, in the recording apparatus disclosed in JP-A-2014-227293, a roller pair that discharges and reversely transports the preceding medium after the recording is provided, and passing-each-other transport is performed in which the preceding medium and the following medium are transported in mutually opposite directions along a gap between a pair of separated rollers.

However, in the recording apparatus disclosed in JP-A-2014-227293, since two sheets of paper cross each other along a narrow gap between separated rollers, two sheets of media is transported while rubbing against each other and crossing each other.

When there is a broken part or the like at an end of the medium, catching is generated by the passing-each-other of the medium, and thus a jam is likely to occur. Further, unlike a laser printer disclosed in JP-A-2014-227293, when the recording apparatus performs printing by discharging a liquid such as an ink, which is like an ink jet printer disclosed in JP-A-2016-193555, since printed surfaces which are not dried rub against each other, as a coefficient of friction between the media increases, a transport load of the medium increases, and accuracy of a transport position of the medium decreases, which causes deterioration of printing quality. Further, when a medium such as a paper sheet to which an ink adheres is easy to curl, and the curled media rub each other, an occurrence frequency of the jam increases. In this way, when the passing-each-other transport is performed while the two sheets of media rub against each other, there is a problem in that inconvenience such as deterioration in print quality and an increase in the occurrence frequency of the jam are likely to occur.

SUMMARY

An advantage of some aspects of the present disclosure is to provide a recording apparatus that can reduce inconvenience caused by rubbing of two media transported in opposite directions simultaneously in a gap between a separated roller pair.

Hereinafter, means of the present disclosure and operation effects thereof will be described.

According to an aspect of the present disclosure, a recording apparatus includes a recording unit that performs recording by discharging an ink to a recording medium, a first transport path through which the recording medium is transported in a first direction during the recording by the recording unit, a second transport path which is connected to the first transport path at a downstream position of the recording unit in the first direction, and through which the recording medium recorded by the recording unit is transported along a path that is different from the first transport path in a second direction that is different from the first direction, a roller pair that is configured to apply a transport force to the recording medium in the first direction and the second direction at a downstream position of the recording unit in the first direction and that is configured to be displaced between a nipping position where the recording medium is configured to be transported while being nipped and a separation position where it is separated from the nipping position, and a variable member that is disposed downstream of the recording unit in the first direction, and is configured to be displaced between an advanced position where the variable member is advanced to the first transport path side and a retraction position where the variable member is more retracted from the first transport path than the advanced position, in which when a following recording medium is transported on the first transport path, a preceding recording medium is transported on the second transport path, and the respective recording media are disposed at a position of the roller pair at the same time, the roller pair is disposed at the separation position, and the variable member is disposed at the advanced position.

With this configuration, the preceding recording medium and the following recording medium may be transported in opposite directions in a gap formed by disposing the roller pair at the separation position. Moreover, as the variable member is advanced to the first transport path side, a force may be applied in a direction in which the two recording media are separated from each other. Therefore, when the preceding recording medium and the following recording medium pass through the gap between the roller pair disposed at the separation position, both the recording media may be separated from each other or even if both the recording media come into contact with, contact resistance may be kept small. Thus, it is possible to reduce inconvenience caused by rubbing of the two recording media transported in opposite directions at the same time through the gap between the roller pair.

In the recording apparatus, the variable member may be a flap, may be disposed at a position where the recording medium being transported on the first transport path at the retraction position may be supported so as to guide to the roller pair, and may be disposed at a position where the recording medium is fed to the second transport path at the advanced position.

With this configuration, by controlling an inclination of the flap, it is possible to guide the recording medium and control a transport direction thereof. When the flap is located at the retraction position, the recording medium may be guided to the roller pair, and when the flap is located at the advanced position, in a process in which the recording medium passes through the gap between the roller pair disposed at the separation position, it is possible to avoid or alleviate contact between the preceding recording medium and the following recording medium.

In the recording apparatus, the second transport path may be a reverse path that is joined to the first transport path at an upstream position of the recording unit in the first direction.

With this configuration, the recording medium transported on the second transport path after recording is performed on the first surface (a single surface) is fed from a joining point with the first transport path to the first transport path, is reversed, and is fed again, so that double-sided recording may be performed in which the recording is performed on the second surface that is opposite to the recorded first surface of the recording medium.

In the recording apparatus, the variable member may be advanced from a surface opposite to a surface recorded by the recording unit to the first transport path.

With this configuration, when the variable member is disposed at the advanced position, since the recording medium is pushed from a surface that is opposite to the recorded surface, even when the variable member comes into contact with the recording medium, deterioration of quality due to rubbing against the recorded surface immediately after the recording may not occur.

In the recording apparatus, the recording apparatus may include a first transport mechanism that transports the recording medium on the first transport path in the first direction in an area including an area facing the recording unit, and a second transport mechanism that transports the recording medium on the second transport path in the second direction.

With this configuration, even when the roller pair, which is responsible for the transport of the recording medium in the first direction and the transport of the recording medium in the second direction, is disposed at the separation position, the following recording medium may be transported by the first transport mechanism, and the preceding recording medium may be transported by the second transport mechanism.

In the recording apparatus, when a trailing end of the preceding recording medium being transported on the first transport path in the first direction passes through a position of the variable member, the variable member is disposed at the advanced position, and the roller pair is reversely rotated to transport the preceding recording medium on the second transport path, when a leading end of the preceding recording medium being transported on the second transport path in the second direction starts to be transported by the second transport mechanism, the roller pair is disposed at the separation position, and when the trailing end of the preceding recording medium being transported on the second transport path in the second direction passes through the position of the variable member, the variable member is disposed at the retraction position, and the roller pair is disposed at the nipping position to perform forward rotation so as to transport the following recording medium in the first direction.

With this configuration, since the variable member is disposed at the advanced position when the trailing end of the preceding recording medium in the first direction passes through the variable member, thereafter, even when the recording medium is reversely transported, the reversely transported recording medium may be guided to the second transport path. Further, when the transport of the recording medium guided to the second transport path is started by the second transport mechanism, since the roller pair is disposed at the separation position, even when the roller pair is disposed at the separation position, the recording medium may be transported on the second transport path. Further, when the trailing end of the preceding recording medium in the second direction passes through the position of the variable member, the variable member may be disposed at the retraction position, the roller pair may be disposed at the nipping position and may perform the forward rotation to transport the following recording medium in the first direction. Thus, it is possible to reduce inconvenience caused by rubbing of the two recording media transported in opposite directions at the same time through the gap between the roller pair.

In the recording apparatus, when a leading end of the following recording medium being transported on the first transport path in the first direction passes through a position between the roller pair disposed at the separation position, the variable member may be disposed at a position further advanced from the advanced position.

With this configuration, when the leading end of the following recording medium transported on the first transport path in the first direction passes through a position between the roller pair disposed at the separation position, since the variable member is disposed at a position further advanced than the advanced position, when the roller pair is in the separation position, the recording medium may be pressed by the variable member in a direction in which the roller pair is more largely separated. Thus, when the two recording media are transported in opposite directions at the same time through the gap of the roller pair at the separation position, the recording medium may be further greatly separated, and even if the two recording media are brought into contact with each other, a contact load between the two recording media may be further suppressed.

In the recording apparatus, when a discharge amount of a liquid discharged to the recording medium by the recording unit is equal to or less than a threshold, in a period in which the recording media being transported on the first transport path and the second transport path, respectively, are disposed at the position of the roller pair at the same time, the roller pair is disposed at the separation position and the variable member is disposed at the advanced position.

With this configuration, when the discharge amount of the liquid discharged for the recording on the recording medium is equal to or less than the threshold, the passing-each-other transport may be performed in which the two recording media are transported in opposite directions at the same time through the gap between the roller pair disposed at the separation position. Meanwhile, when the discharge amount of the liquid exceeds the threshold, the passing-each-other transport is not performed in which the two recording media are transported in opposite directions at the same time through the gap between the roller pair disposed at the separation position. Thus, it is possible to reduce occurrence of inconvenience such as deterioration in recording quality and jamming caused by a relatively large amount of liquid adhering to the recording medium due to a discharge amount of liquid exceeding a threshold and an increase in a contact load between the recording media at which the liquids pass through each other.

In the recording apparatus, the recording apparatus includes the other roller pair for transporting the recording medium other than the roller pair, in which when a type of the recording medium is a second medium type in which the recording is performed at a higher quality than a first medium type, even in the case of single-sided printing, the roller pair is disposed at the separation position in a period in which the recording medium is configured to be transported by the other roller pair.

With this configuration, a roller mark which is attached by being nipped by the roller pair is reduced on the recording medium which is the second medium type.

DESCRIPTION OF EXEMPLARY EMBODIMENTS

Figure 1:
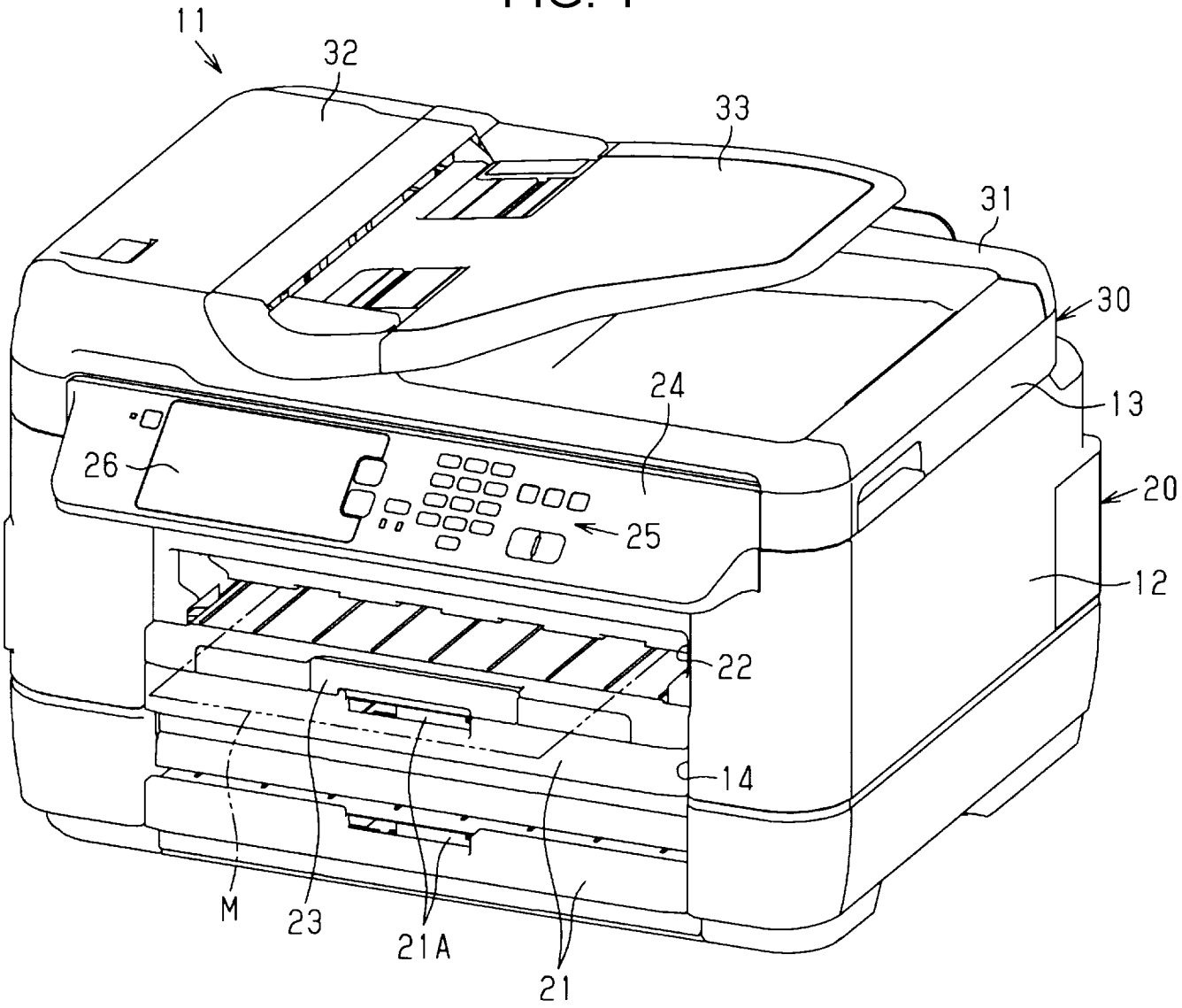
FIG. 1 is a perspective view illustrating a recording apparatus according to a first embodiment.

Hereinafter, an embodiment of a recording apparatus will be described with reference to the drawings. A recording apparatus 11 illustrated in FIG. 1 is an ink jet printer using a serial printing method. As illustrated in FIG. 1, the recording apparatus 11 includes a rectangular parallelepiped casing 12 and a cover 13 provided on the casing 12. The recording apparatus 11 illustrated in FIG. 1, which is an example of a multi-functional periphery, has a printer unit 20 occupying most of the casing 12 and a scanner unit 30 configured by an upper end portion of the casing 12 and the cover 13. In the recording apparatus 11, a cassette 21 in which a recording medium M (hereinafter, simply referred to as a "medium" M) such as a paper sheet is accommodated is inserted into a recess 14 opened in a lower portion of a front surface of the casing 12. In an example illustrated in FIG. 1, although the cassette 21 is provided vertically in two stages, the cassette 21 may be provided in one stage or may be provided in the vertical direction Z in three or more of stages. A to-be-operated portion 21A that can be detachably attached by hanging a finger thereon by a user is provided in a central portion of a front surface of each cassette 21.

In the casing 12, a discharge port 22 through which the printed medium M is discharged is opened on an upper side of the cassette 21. An expandable discharge tray 23 (a stacker) that receives the discharged medium M after the printing is provided at a lower portion of the discharge port 22. In the casing 12, an operation panel 24 is disposed above the discharge port 22. An operation unit 25 including a plurality of switches operated when the user provides an instruction to the recording apparatus 11 and a display unit 26 on which a menu or the like is displayed are provided in the operation panel 24. The operation unit 25 includes operation switches such as a power switch, a selection switch operated when an item of the menu of the display unit 26 is selected, a print starting switch that instructs printing, and a copy starting switch that instructs copying.

Further, as illustrated in FIG. 1, the cover 13 provided on the casing 12 openably and closeably through a not-illustrated hinge serves as a document stand cover 31 of the scanner unit 30 in this example. An automatic document feeder 32 including a document tray 33 on which a plurality of documents can be placed (set) is mounted on the document stand cover 31. The scanner unit 30 includes a flat-bed-type scanner function of placing a document on a document stand (a glass surface) exposed when the document stand cover 31 is opened and reads the document and a sheet-feeder-type scanner function of automatically feeding and reading the document set on the document tray 33 one by one. Further, the document can be copied by the scanner function of the scanner unit 30 and the printer function of the printer unit 20.

The recording apparatus 11 illustrated in FIG. 1 can perform printing on the medium M having a size of up to, for example, A3 size. Further, the recording apparatus 11 has a single-sided printing function of performing printing on only a single surface (a first surface) of the medium M and a double-sided printing function of performing printing on both surfaces (the first surface and a second surface) of the medium M. When the recording apparatus 11 is used for business, high-speed printing is required for both the single-sided printing and the double-sided printing. In the double-sided printing, since an operation of reversing the medium M, of which the printing on the single surface (the first surface) has been completed, in a direction in which the printing on an opposite surface (the second surface) can be performed, and feeding the medium M again, the reversing feeding operation causes a reduction in printing throughput. The recording apparatus 11 according to the present embodiment performs the printing at a time of the double-sided printing at a high speed by shortening or eliminating a standby time of the following medium M during the reversing feeding operation of the preceding medium M.

Figure 2:
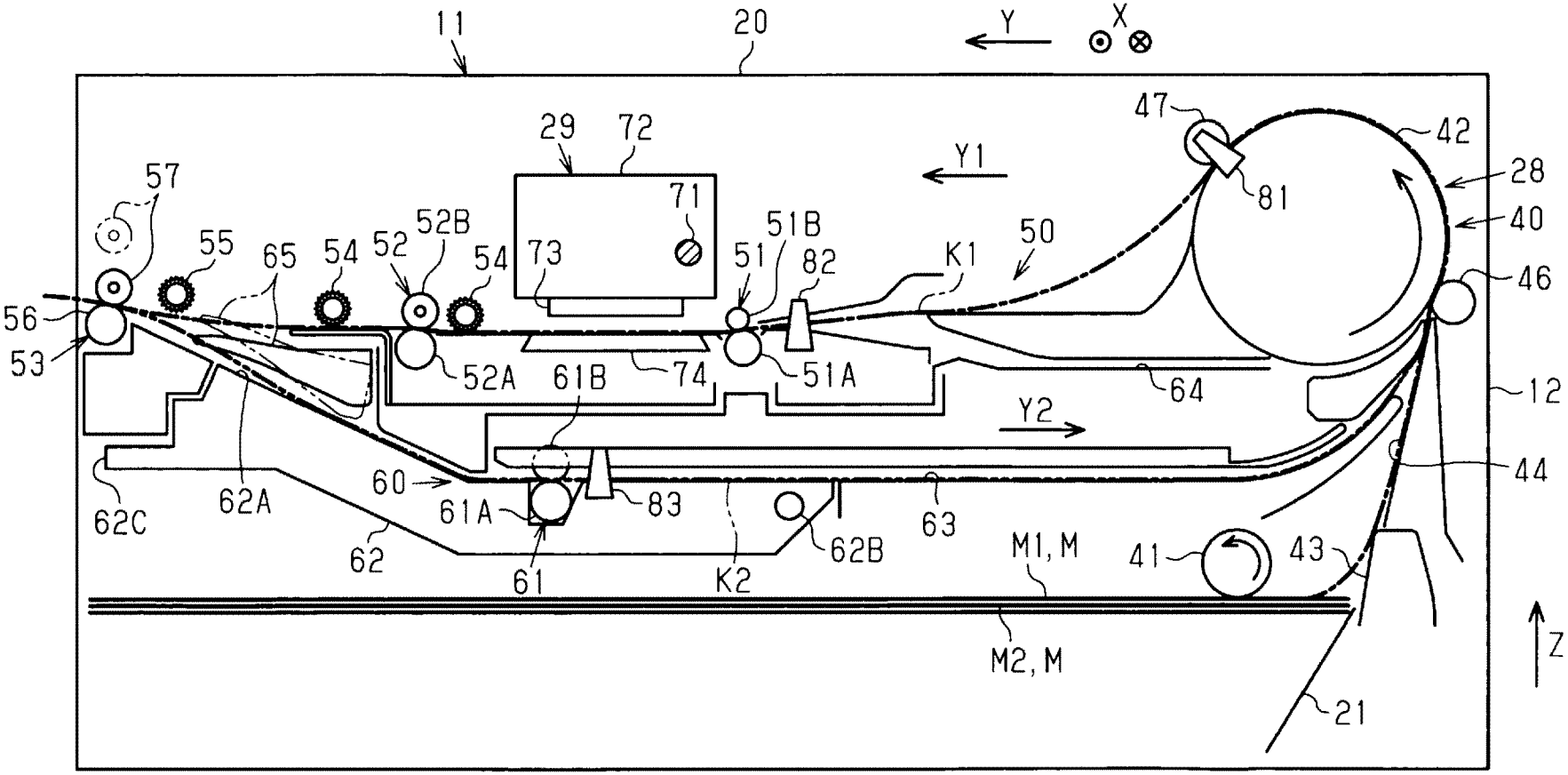
FIG. 2 is a schematic side sectional view illustrating a printer unit in the recording apparatus.

Next, the recording apparatus 11 will be described in detail with reference to FIG. 2. FIG. 2 is a schematic side sectional view illustrating the recording apparatus 11, the scanner unit 30 is omitted, and only one cassette 21 is illustrated. In the above description, a direction in which a recording unit 29 performs scanning to perform printing on the medium M (a direction that is perpendicular to a paper surface in FIG. 2) is set as a scanning axis X, and a direction in which the medium M is transported at a position where the recording unit 29 performs the printing is set as a transport direction Y. In the present embodiment, the axis direction X and the transport direction Y intersect each other (for example, are perpendicular to each other), and both the directions intersect (for example, are perpendicular to) a vertical direction Z.

As illustrated in FIG. 2, a plurality of the media M are accommodated in the cassette 21 disposed below the casing 12 in the recording apparatus 11. The casing 12 includes a transport mechanism 28 that transports the medium M and the recording unit 29 that performs recording by discharging a liquid such as an ink to the medium M.

The recording apparatus 11 has a first transport path K1 indicated by a thick dashed line in FIG. 2 and a second transport path K2 indicated by a thick two-dot chain line in the same figure as a transport path through which the transport mechanism 28 transports the medium M. The first transport path K1 is a path through the medium M is transported in a first direction Y1 by the recording unit 29 during the recording. The second transport path K2 is a path which is connected to the first transport path K1 at a downstream position of the recording unit 29 in the first direction Y1 and through which the medium M recorded by the recording unit 29 is transported to a path that is different from the first transport path K1 in a second direction Y2 that is different from the first direction Y1. The second transport path K2 is a path through which the medium M of which only the single surface transported through the first transport path K1 is recorded is switched back to a downstream end position of the first transport path K1 in the first direction Y1 during the double-sided printing, and then the medium M after the switchback is carried in from a distal end in the first direction Y1. The second transport path K2 is a reverse path for reversing the medium M of which the single surface has been completely recorded during the double-sided printing, and is joined to the first transport path K1 at an upstream position of the recording unit 29 in the first direction Y1. In the present embodiment, as illustrated in FIG. 2, the second transport path K2 is joined to the first transport path K1 at an intermediate position of a feeding path through which a feeding mechanism 40, which is an upstream position of the recording unit 29 in the first direction Y1, transports the medium. After passing through the joining point, the medium M, which is transported on the second transport path K2 in the second direction Y2 and of which only the single surface is recorded, is reversed back and forth through the first transport path K1 and is re-fed to a recording area where the recording unit 29 performs the recording. In the case of the single-sided printing, after printing is performed on the first surface by the recording unit 29, the medium M is discharged through the first transport path K1.

Next, a detailed configuration of the transport mechanism 28 that transports the medium M will be described. The transport mechanism 28 includes a feeding mechanism 40 that feeds the medium M, a first transport mechanism 50 that transports the medium M in an area including an area facing the recording unit 29 on the first transport path K1 in the first direction Y1, and a second transport mechanism 60 that transports the medium M on the second transport path K2 in the second direction Y2.

The feeding mechanism 40 feeds the medium M in the cassette 21 one by one from the uppermost side. The first transport mechanism 50 performs a transport operation of transporting the medium M fed from the feeding mechanism 40 in a path passing through an area recorded by the recording unit 29, a discharge operation of discharging the medium M recorded by the recording unit 29, and a switchback operation of reversing the medium M during the double-sided printing. Further, the second transport mechanism 60 transports the medium M, pulled into the second transport path K2 by the switchback operation and transported in the second direction Y2 during the double-sided printing, on the second transport path K2 to a junction point between the first transport path K1 and the second transport path K2 in order to reverse the medium M. The medium M of which the printing on the single surface is performed during the double-sided printing is fed to the recording unit 29 again via the second transport path K2 and the first transport path K1.

As illustrated in FIG. 2, the feeding mechanism 40 includes a feeding roller 41 (a pickup roller) that feeds out an uppermost one among the medium M in the cassette 21 and an intermediate roller 42 that feeds the medium M fed out by the feeding roller 41 to the recording unit 29 that performs the recording (the printing). The feeding roller 41 rotates in an arrow direction to feed out the uppermost one among the medium M in the cassette 21 in the second direction Y2. A leading end of the fed-out medium M hits a separation wall 43 so that the fed-out medium M is separated from the following medium M. Only the separated one medium M is fed to the intermediate roller 42 located above a guide 44 along the guide 44.

The intermediate roller 42, which is a roller having a larger diameter than the other rollers, is in contact with a first roller 46 and a second roller 47 at two points on an outer peripheral surface of the intermediate roller 42. Thus, the medium M is nipped at two positions including a first nip position where the intermediate roller 42 and the first roller 46 are in contact with each other and a second nip position where the intermediate roller 42 and the second roller 47. As the intermediate roller 42 rotates in the arrow direction, the medium M nipped at the two positions is fed to the recording unit 29 on the first transport path K1. The feeding roller 41 and the intermediate roller 42 rotate by power of a feeding motor 101 illustrated in FIG. 3.

The first transport mechanism 50 includes a first transport roller pair 51, a first discharge roller pair 52, a second discharge roller pair 53 as an example of a roller pair, a plurality of floating rollers 54 and 55, and the like. A first transport roller pair 51 includes a driving roller 51A and a driven roller 51B. A first discharge roller pair 52 includes a driving roller 52A and a driven roller 52B. A second discharge roller pair 53 includes a driving roller 56 and a driven roller 57.

Further, the second transport mechanism 60 includes a second transport roller pair 61. A second transport roller pair 61 includes a driving roller 61A and a driven roller 61B. The second transport roller pair 61 is disposed at a position close to the upper stream side in the second direction Y2 of the second transport path K2. A route guiding surface (a guide surface) that guides the medium M on the second transport path K2 includes a slope 62A of which a portion extending from a junction point located near the second discharge roller pair 53 to a downstream side of the second direction Y2 slopes obliquely downward and a guide surface 63 serving as a curved surface extending substantially horizontally from the vicinity of a lower end of the slope 62A and directed to the upper side at a portion close to the downstream side end portion in the second direction Y2. A guide member 62 forming a guide surface of the second transport path K2 is provided rotatably about a rotary shaft 62B, and the guide member 62 is pushed down by operating a gripping portion 62C at an end portion thereof. Thus, a portion of the second transport path K2 is exposed, and it is possible to eliminate the jam of the medium M occurring in the second transport path K2.

The second discharge roller pair 53 may apply a transport force to the medium M at a downstream position of the recording unit 29 in the first direction Y1, in the first direction Y1 and the second direction Y2, and may be displaced between a nipping position where the medium M can be transported while being nipped and a separation position (a release position) that is separated from the nipping position (the nip position). In the present embodiment, the driven roller 57 of the second discharge roller pair 53 can be displaced. As the driven roller 57 is displaced, the second discharge roller pair 53 may be displaced between the nipping position and the separation position.

The recording apparatus 11 includes a flap 65 that is disposed downstream of the recording unit 29 in the first direction Y1 and is as an example of a variable member. The flap 65 can be displaced between a first position as an example of a retraction position where the medium M is supportably retracted with respect to the first transport path K1 and a second position as an example of an advanced position where the medium M is advanced closer to the first transport path K1 than the first position. In other words, the flap 65 can be displaced between a second position where the medium M is advanced close to the first transport path K1 and a first position where the medium M is retracted further away from the first transport path K1 than the second position. In the present embodiment, the flap 65 is rotatably disposed below the first transport path K1, and is advanced to the first transport path K1 from a surface (for example, a rear surface) opposite to a surface (for example, a front surface) recorded by the recording unit 29. In the first position (the retraction position), the flap 65 is disposed at a position where the medium M transported on the first transport path K1 is supported to face the second discharge roller pair 53. In the second position (the advanced position), the flap 65 is disposed at a position where the medium M is sent in the second transport path K2 while a distal end of the medium M in the first direction Y1, which is reversely transported when the distal end of the medium M1 passes through the flap 65 in the first direction Y1, is directed to the lower side. In FIG. 2, a preceding medium that is a preceding recording medium among the recording medium M is designated by M1, and a following medium that is a following recording medium is designated by M2. Here, the preceding medium M1 denotes the medium M previously fed from the cassette 21, and the following medium M2 denotes the medium M fed from the cassette 21 next to the preceding medium M1.

Figure 7:
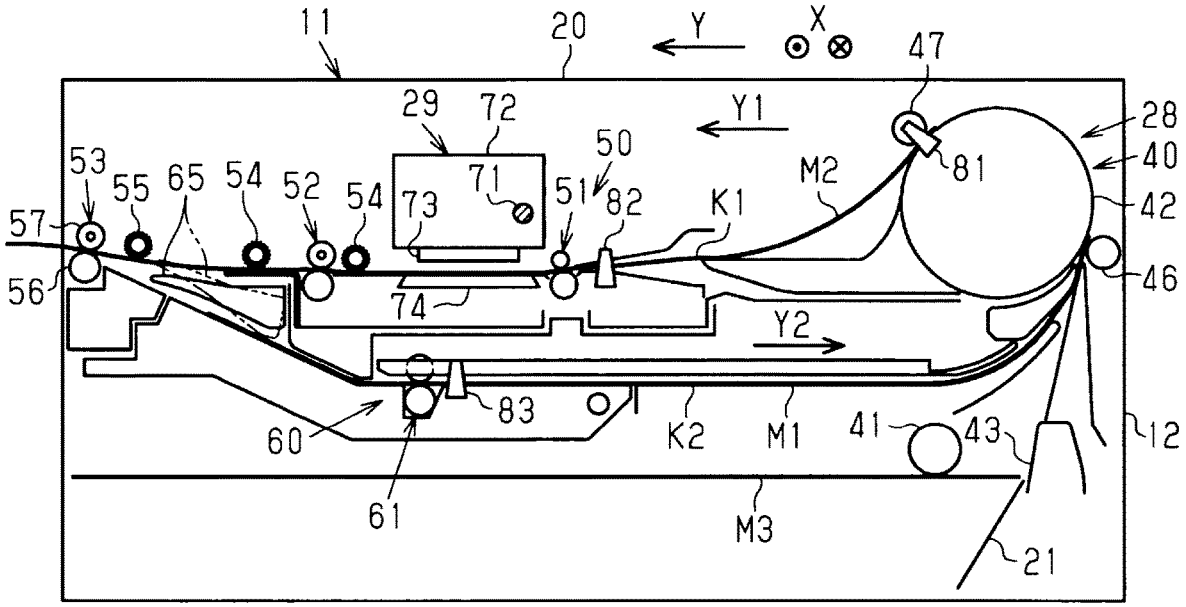
FIG. 7 is the same schematic side sectional view.

In the recording apparatus 11, in the case of the double-sided printing performed by continuously feeding the medium M having a predetermined length or less and in the case of the single-sided printing of performing facedown discharge in which the medium M is continuously fed, a printed surface is directed to the lower side after printing, and the medium M is discharged to the discharge tray 23, the media M1 and M2 are transported to the first transport path K1 and the second transport path K2, respectively (see FIG. 7). That is, the medium M of which the printing on the first surface is completed and which is discharged in the first direction Y1 by the first discharge roller pair 52 and the second discharge roller pair 53 is reversely transported in the second direction Y2 when a distal end of the medium M passes through the flap 65 and is guided by the flap 65 disposed from the first position to the second position before the reverse transportation to be sent to the second transport path K2. During the switchback operation in which the preceding medium M1 is sent from the first transport path K1 to the second transport path K2, printing on the following medium M2 is continued. In this case, depending on the size of the medium and the length of an image to be printed, when the preceding medium M1 during the switchback operation is positioned at the second discharge roller pair 53, the following medium M2 may be positioned at the second discharge roller pair 53. When the media M1 and M2 are disposed at the second discharge roller pair 53 at the same time, the second discharge roller pair 53 is disposed at the separation position and the flap 65 is disposed at the second position (the advanced position). When the double-sided printing is performed on the medium M of which the length in the transport direction Y is shorter than a predetermined length one by one, a part of the first transport path K1 and a reverse passage 64 may be used as a reverse path to shorten the length of the reverse path.

Further, as illustrated in FIG. 2, the recording apparatus 11 includes a first sensor 81 provided in the middle of the feed path in the first transport path K1, a second sensor 82 provided in the middle of the first transport path K1, and a third sensor 83 provided in the middle of the second transport path K2.

The recording unit 29 illustrated in FIG. 2, which uses a serial printing method, includes a carriage 72 that can reciprocate in the scanning direction X along a guide shaft 71 installed while extending in the scanning direction X intersecting the transport direction Y of the medium M in the casing 12. The carriage 72 has a recording head 73 formed at a lower portion thereof facing the first transport path K1 to discharges an ink to the medium M. The carriage 72 moves in the scanning direction X, and the recording head 73 discharges the ink to the medium M during the movement, so that a letter and an image is recorded on the medium M. The recording head 73 is positioned downstream of the first transport roller pair 51 in the transport direction Y and upstream of the first discharge roller pair 52 in the transport direction Y. A support 74 for supporting the medium M is disposed at a position facing a movement path of the recording head 73 with the first transport path K1 interposed therebetween.

Figure 4:
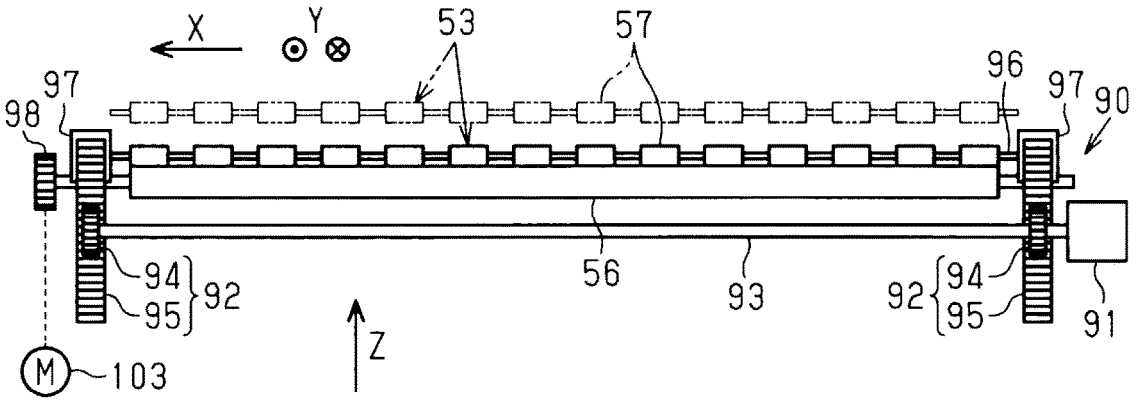
FIG. 4 is a schematic front view illustrating a contact and separation mechanism of a second discharge roller pair.

Next, a configuration of a driving mechanism 90 that disposes the second discharge roller pair 53 at the nipping position and the separation position will be described with reference to FIG. 4. As illustrated in FIG. 4, the driving mechanism 90 (a release mechanism) that drives the second discharge roller pair 53 to the nipping position and the separation position includes an electric motor 91 and a rack and pinion mechanism 92. The rack and pinion mechanism 92 includes a pair of pinions 94 fixed to opposite end portions in the scanning direction X which is a longitudinal direction of the rotary shaft 93 connected to an output shaft of the electric motor 91 and a pair of racks 95 engaged with the pair of pinions 94. The pair of racks 95 are fixed to a pair of support members 97 that rotatably support opposite end portions of a rotary shaft 96 of the driven roller 57.

When the medium M is transported, the driven roller 57 is disposed at a lowered position indicated by a solid line of FIG. 4, and the second discharge roller pair 53 is disposed at the nipping position where the medium M between the driving roller 56 and the driven roller 57 can be nipped. When the electric motor 91 performs forward rotation driving from a state in which the second discharge roller pair 53 is located at the nipping position, and the driven roller 57 is disposed at a raised position where the driven roller 57 is separated from the driving roller 56 as indicated by a two-dot chain line of FIG. 4, so that the second discharge roller pair 53 is disposed at the separation position. When the electric motor 91 performs reverse rotation driving from a state in which the second discharge roller pair 53 is located at the separation position, the driven roller 57 is lowered and returns to the lowered position, so that the second discharge roller pair 53 returns to the nipping position. Further, rotation of a second transport motor 103 (see FIG. 3) is input to a gear 98 fixed to a shaft end portion of the driving roller 56 through a gear mechanism 106 (see FIG. 3), so that the driving roller 56 rotates.

Figure 3:
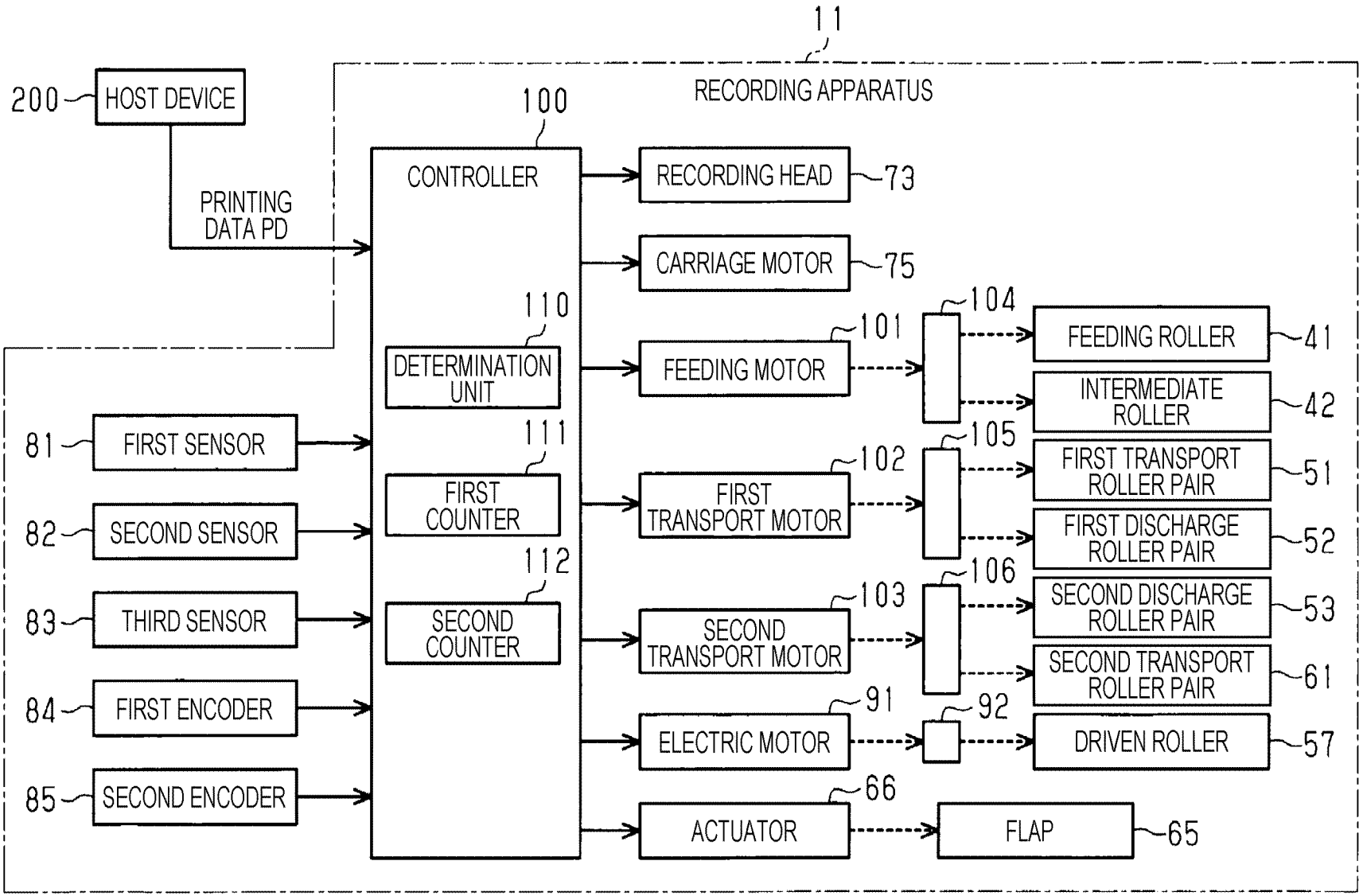
FIG. 3 is a block diagram illustrating an electric configuration of the recording apparatus.

Next, an electric configuration of the recording apparatus 11 will be described with reference to FIG. 3. In FIG. 3, the scanner unit 30 is omitted. As illustrated in FIG. 3, the recording apparatus 11 includes a controller 100. The controller 100 has a not-illustrated computer and a not-illustrated memory embedded therein, and the computer executes a program stored in the memory to perform various kinds of printing control. The recording apparatus 11 is communicably connected to a host device 200. The controller 100 performs the printing control based on printing data PD received from the host device 200.

The first sensor 81, the second sensor 82, the third sensor 83, a first encoder 84, and a second encoder 85 are electrically connected to an input terminal of the controller 100. The recording head 73, a carriage motor 75, the feeding motor 101, a first transport motor 102, the second transport motor 103, the electric motor 91, and an actuator 66 are electrically connected to an output terminal of the controller 100. The controller 100 is electrically connected to the scanner unit 30 and also controls a reading operation of the scanner unit 30.

Here, a relationship between rotation directions of the motor 101 to 103 and rotation directions of the roller pairs 51 to 53 and 61 will be described. As illustrated in FIG. 3, the feeding motor 101 is connected to the feeding roller 41 and the intermediate roller 42 through the gear mechanism 104 to enable power transmission. When the feeding motor 101 performs forward rotation driving, both rollers 41 and 42 perform forward rotation, and when the feeding motor 101 performs reverse rotation driving, the intermediate roller 42 performs forward rotation, and the feeding roller 41 is stopped. Accordingly, the feeding roller 41 rotates to feed the following medium M2 to a standby position before the first nip position of the intermediate roller 42, and while the following medium M2 is kept in the standby position, the preceding medium M1 can be transported by rotating the intermediate roller 42.

The first transport motor 102 is connected to the first transport roller pair 51 and the first discharge roller pair 52 through the gear mechanism 105 to enable power transmission. Each of the roller pairs 51 and 52 performs forward rotation when the first transport motor 102 performs forward rotation driving, to transport the medium M in the first direction Y1, and performs reverse rotation when the first transport motor 102 performs reverse rotation driving, to transport the medium M in the second direction Y2.

The second transport motor 103 is connected to the second discharge roller pair 53 and the second transport roller pair 61 through the gear mechanism 106 to enable power transmission. The second discharge roller pair 53 performs forward rotation when the second transport motor 103 performs forward rotation driving, to transport the medium M in the first direction Y1, and performs reverse rotation when the second transport motor 103 performs reverse rotation driving, to transport the medium M in the second direction Y2. Further, the second transport roller pair 61 is stopped when the second transport motor 103 performs forward rotation driving and performs reverse rotation when the second transport motor 103 performs reverse rotation driving, to transport the medium M in the second direction Y2 on the second transport path K2. For example, the medium M is transported in the second direction Y2 on the second transport path K2 by the reverse rotation driving of the second transport motor 103, and the medium M transported in the second direction Y2 is stopped at the standby position before the first nip position by the forward rotation driving of the second transport motor 103.

Further, the electric motor 91 is connected to the driven roller 57 through the rack and pinion mechanism 92 to enable power transmission (see FIG. 4). Further, the actuator 66 is connected to the flap 65 to enable power transmission. As the actuator 66 is driven, the flap 65 is disposed at the first position (the retraction position) where the medium M can be supported and can be guided to the second discharge roller pair 53 as indicated by a solid line in FIG. 2 or the second position (the advanced position) where the medium M is advanced to the first transport path K1 as indicated by a two-dot chain line in FIG. 2.

Further, as illustrated in FIG. 3, the controller 100 includes a determination unit 110, a first counter 111, and a second counter 112. The determination unit 110 determines whether to perform the single-sided printing or the double-sided printing, whether the length of the medium M is long or short, an amount of ejected ink (an amount of discharged ink), whether or not there is the following medium, whether to perform single-sided facedown discharge, and necessity of separating the second discharge roller pair 53 depending on conditions such as the type of the medium.

The first sensor 81 detects a leading end or a distal end of the medium M while the medium M is fed. As a not-illustrated counter counts the number of pulse edges of a pulse signal input from a not-illustrated encoder for detecting rotation of the feeding motor 101, the controller 100 identifies a position of a leading end and a position of a distal end of the medium M on the feeding path based on the counted value and information on the size of the medium M. The position of the distal end of the medium M is used for determining a feeding start timing of the following medium.

The second sensor 82 detects the positions of the leading end and the distal end of the medium M transported on the first transport path K1. After the second sensor 82 detects a leading end of the medium M, the first counter 111 counts the number of the pulse edges of the pulse signal from the first encoder 84 for detecting rotation of the first transport motor 102. Thus, the controller 100 identifies the position of the leading end of the medium M mainly on the first transport path K1 based on the counted value. Further, after the second sensor 82 detects a distal end of the medium M, the first counter 111 counts the number of the pulse edges of the pulse signal from the first encoder 84. Thus, the controller 100 identifies the position of the distal end of the medium M mainly on the first transport path K1 based on the counted value.

The third sensor 83 detects the positions of the leading end and the distal end of the medium M transported on the second transport path K2. After the third sensor 83 detects the leading end of the medium M in the second direction Y2, the second counter 112 counts the number of pulse edges of a pulse signal from the second encoder 85 for detecting rotation of the second transport motor 103. Thus, the controller 100 identifies the position of the leading end of the medium M mainly on the second transport path K2 based on the counted value. Further, after the third sensor 83 detects a distal end of the medium M in the second direction Y2, the second counter 112 counts the number of the pulse edges of the pulse signal from the second encoder 85. Thus, the controller 100 identifies the position of the distal end of the medium M mainly on the second transport path K2 based on the counted value.

The third sensor 83 on the second transport path K2 has a function of detecting whether or not the leading end of the medium M in the second direction Y2 is nipped by the second transport roller pair 61 and a function of detecting the medium M at a halfway position since a transport distance to the first sensor 81 to be detected next is long. A jam occurring in the middle of the second transport path K2 can be detected at an early stage by the latter function. That is, a case where even when a transport amount after detection by the third sensor 83 reaches a predetermined value, the medium M to be detected by the first sensor 81 is not detected is detected as the jam. Further, in order to determine whether the medium M on the second transport path K2 reaches the standby position before the first nip position between the intermediate roller 42 and the first roller 46, the counted value of the second counter 112 is used. When the leading end of the medium M reaches the standby position before the first nip position, the controller 100 causes the second transport motor 103 to perform reverse rotation driving. Accordingly, until the trailing end of the medium M passes through a predetermined position on an outer peripheral surface of the intermediate roller 42 while the medium M on the first transport path K1 is transported in the first direction Y1 by the forward rotation of the second discharge roller pair 53, it is possible to cause the medium M on the second transport path K2 to stand by at the standby position before the first nip position.

The recording apparatus 11 is wired or wirelessly communicably connected to the host device 200. The controller 100 receives the printing data PD from the host device 200. The printing data PD includes printing condition information and printing image data. The controller 100 acquires information on the size of the medium (a medium size), the type of the medium (a medium type), whether or not to perform the double-sided printing (the double-sided printing or the single-sided printing), a color of the printing (a color or a gray scale), printing quality (normal printing or high definition printing), and the number of printed sheets, based on the printing condition information. When A3 format exceeding a predetermined size is specified as the medium M, and a plurality of sheets of the double-sided printing are instructed, a one-sheet circulation transport method is set in which the medium M is circulated and transported one by one with a switchback at a joining point downstream of the transport direction Y along a circulation path including the transport paths K1 and K2, so that the double-sided printing is performed. Meanwhile, when the medium M is specified as a predetermined size or less, for example, A4 format or less, and the double-sided printing on a plurality of sheets is instructed, a two-sheet circulation transport method is set in which the preceding medium M1 and the following medium M2 are circulated and transported at once with the switchback at the joining point downstream of the transport direction Y along the circulation path including the transport paths K1 and K2, so that the double-sided printing is performed. Further, when the two-sheet circulation transport method is set, one of first transport control and second transport control is selected based on a result of the determination by the determination unit 110. In the case of the single-sided printing, even when the face-down discharge is performed in which the medium M is discharged while a surface to be printed of the medium M is directed to the lower side, if the size of the medium M exceeds the predetermined size, the one-sheet circulation transport method is set, and if the size of the medium M is equal to or less than the predetermined size, the two-sheet circulation transport method is set. In the case of the face-down discharge, printing is performed only on the first surface, and the medium M is reversed after the printing on the first surface and is discharged while the first surface is directed to the lower side.

In the case of the double-sided printing and the face-down discharge, when the two-sheet circulation transport method is selected, the controller 100 switches between the first transport control and the second transport control depending on an ejection amount (a discharge amount) by which the ink is discharged and driven to the medium M to perform the printing on the medium M. In the first transport control, the flap 65 is disposed at the advanced position while the second discharge roller pair 53 is disposed at the separation position, and the reverse transportation for the switchback operation of the preceding medium M1 in the second direction Y2 and the transportation for the printing of the following medium M2 in the first direction Y1, so that the preceding medium M1 and the following medium M2 are transported while passing through each other through a gap between the second discharge roller pair 53 located at the separation position. In the second transport control, the switchback for reversing the preceding medium M1 from the first transport path K1 to the second transport path K2 is terminated. Until a trailing end of the preceding medium M1 in the second direction Y2 passes through the second discharge roller pair 53, the following medium M2 waits in front of the flap 65.

Figure 15:
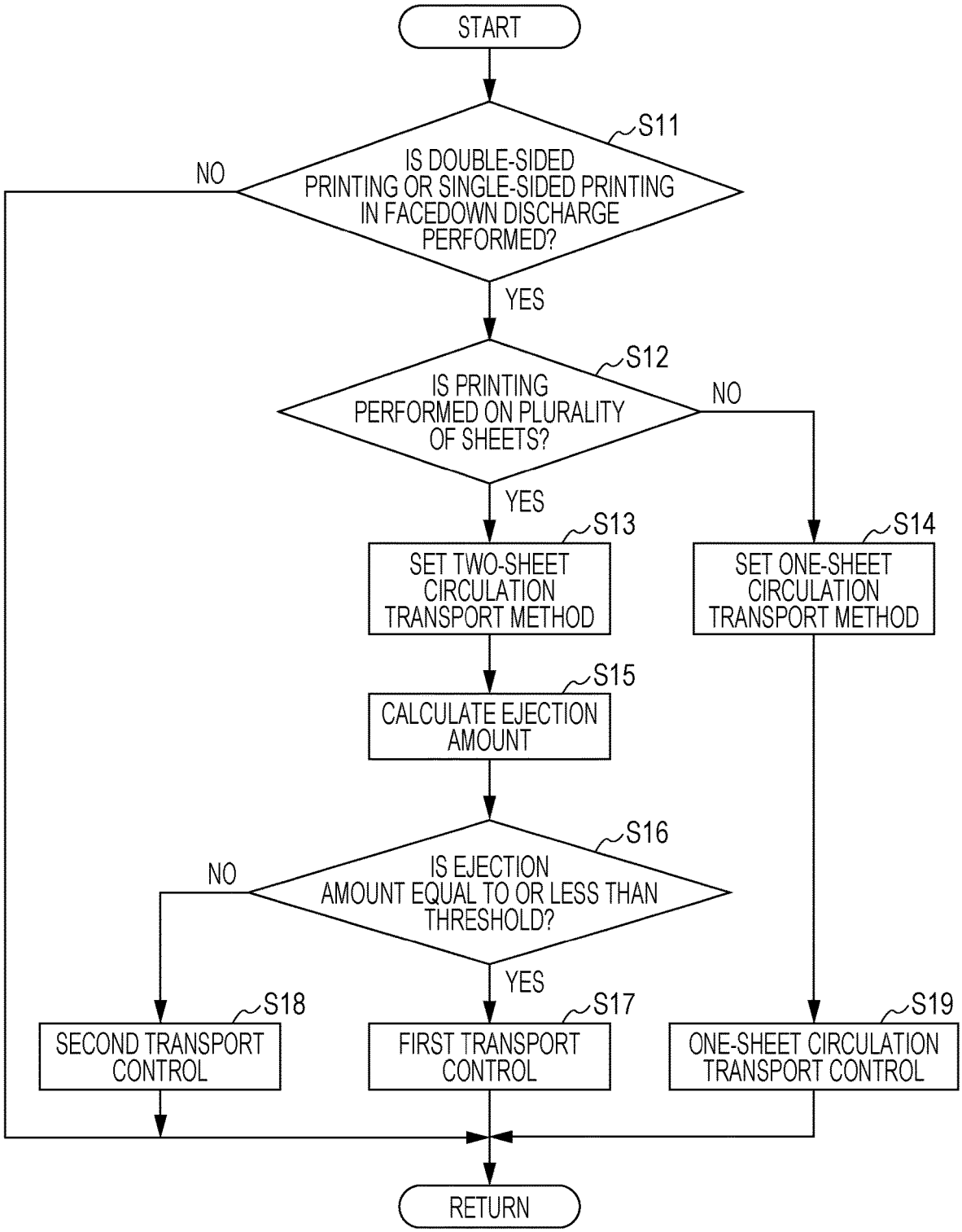
FIG. 15 is a flowchart illustrating a transport control routine including determination processing.

The controller 100 includes a not-illustrated CPU and a not-illustrated memory. A program illustrated in a flowchart of FIG. 15, which the CPU stores in the memory, is executed, so that the transport control including the determination processing by the determination unit 110 is performed. Hereinafter, a transport control routine performed by the controller 100 will be described with reference to FIG. 15.

First, in step S11, the controller 100 determines whether or not the double-sided printing or the single-sided printing in the face-down discharge is performed, based on the printing data PD. When the double-sided printing or the single-sided printing in the face-down discharge is performed, the controller 100 proceeds to step S12, and otherwise the corresponding routine is terminated.

In step S12, the controller 100 determines whether or not printing is performed on a plurality of sheets. When the printing is performed on the plurality of sheets, the process proceeds to step S13, and when the printing is not performed on the plurality of sheets, that is, when the printing is performed on one sheet, the process proceeds to step S14.

In step S13, the controller 100 sets the two-sheet circulation transport method.

Further, in step S14, the controller 100 sets the one-sheet circulation transport method. When the one-sheet circulation transport method is set, the process proceeds to step S19, and the controller 100 performs the one-sheet circulation transport control.

In step S15, the controller 100 calculates the ejection amount. That is, the controller 100 calculates the amount of discharged ink which the recording head 73 discharges to the medium M as the ejection amount of the ink to the medium M. Since the ejection amount is used for determining whether the passing-each-other transport is performed, it is preferable that the controller 100 specifies a passing-each-other area to which an ejection amount of ink used for the determination is applied, and calculates the ejection amount in the passing-each-other area. In detail, it is preferable to acquire the amount of an ink to be ejected in the passing-each-other area which is an area where the media M1 and M2 face each other when the passing-each-other transport is executed in which the preceding medium M1 and the following medium M2 are transported to pass through the gap between the second discharge roller pair 53 at the separation position in directions that are opposite to each other. That is, the controller 100 calculates the ejection amount of the ink at the passing-each-other area with an area near the trailing end except for a portion near the front end in the second direction Y2 after the preceding medium M1 already moves to the second transport path K2 by the switchback, as the passing-each-other area. Further, the controller 100 calculates the ejection amount of the ink at the passing-each-other area where the following medium M2 and the preceding medium M1 cross each other at the gap between the second discharge roller pair 53 located at the separation position. Here, since a pixel value of the printing image data included in the printing data PD is a value defining the discharge amount of ink droplets discharged from a nozzle of the recording head 73, the controller 100 calculates the ejection amount based on the pixel value of the printing image data. In detail, the controller 100 obtains the passing-each-other area of the preceding medium M1 and the following medium M2 based on the printing condition information included in the printing data PD and image contents, adds pixel values in the obtained passing-each-other area for colors, and further calculates a cumulative pixel value by summing the added values for colors. Further, the controller 100 calculates an average ejection amount by dividing a cumulative pixel value by the area of the passing-each-other area. Thus, the determination unit 110 determines whether the average ejection amount of the passing-each-other area in the preceding medium M1 and the following medium M2 exceeds a threshold. The passing-each-other area is calculated for each medium M depending on differences in a printing image, a margin amount, the number of empty lines, a movement distance of each scanning (passing) of the recording head 73, a printing mode (a printing speed), and the like.

In step S16, the controller 100 determines whether or not the ejection amount is equal to or less than the threshold. When the ejection amount is equal to or less than the threshold, the process proceeds to step S17, and when the ejection amount is more than the threshold, that is, when the ejection amount exceeds the threshold, the process proceeds to step S18.

In step S17, the controller 100 performs the first transport control. In the first transport control, the controller 100 disposes the second discharge roller pair 53 at the separation position from the nipping position after the leading end of the switched back preceding medium M1 in the second direction Y2 is nipped to the second transport roller pair 61 on the second transport path K2. Further, when the leading end of the following medium M2 in the first direction Y1 reaches a guidable position where the following medium M2 is guided to the second discharge roller pair 53, the controller 100 pivots the flap 65 from the first position (the retraction position) to the second position (the advanced position). Therefore, the passing-each-other transport is performed in which through the gap between the second discharge roller pair 53 located at the separation position, the preceding medium M1 is transported in the second direction Y2, and at the same time, the following medium M2 is transported in the first direction Y1. The distal end of the preceding medium M1 in the second direction Y2 passes through a position of a leading end of the flap 65 in the second direction Y2, the flap 65 pivots from the second position to the first position, and the second discharge roller pair 53 is disposed from the separation position to the nipping position. In the passing-each-other transport, as the preceding medium M1 and the following medium M2 are transported at the same position on the transport path in directions that are opposite to each other, the switchback operation of the preceding medium M1 and the transport operation of the following medium M2 during the printing can proceed at the same time. For example, in the double-sided printing, the double-sided printing can be performed on a plurality of the media M at a high speed by the first transport control. Further, in the case of the single-sided printing in the face-down discharge, the single-sided printing in the face-down discharge can be performed on the medium M at a high speed by the first transport control.

Here, in a configuration of the present example, a time point when the leading end of the following medium M2 in the first direction Y1 reaches the guidable position is a time point when the leading end of the following medium M2 reaches a floating roller 55. This is because when the leading end of the following medium M2 reaches the floating roller 55, even though the flap 65 pivots to the second position, the following medium M2 is guided to the second discharge roller pair 53 by the floating roller 55. In a configuration not having the floating roller 55, it is preferable that a time point when the leading end of the following medium M2 reaches the guidable position be a time point when the leading end of the following medium M2 reaches the second discharge roller pair 53. Further, when a guide member that can guide the medium M to the second discharge roller pair 53 is provided, a time point when the leading end of the following medium M2 reaches the guide member is a time point when the leading end of the following medium M2 in the first direction Y1 reaches the guidable position. In this way, a timing when the flap 65 pivots from the first position to the second position is determined depending on a peripheral configuration of the second discharge roller pair 53.

In step S18, the controller 100 performs the second transport control. The controller 100 performs the second transport control when the ejection amount exceeds the threshold from a result of the determination by the determination unit 110. In the second transport control, the following medium M2 stands by at a standby position before the flap 65, a trailing end of the preceding medium M1 in the second direction Y2 until the switchback of the preceding medium M1 is completed, the printing on the following medium M2 restarts at a timing slightly before the trailing end of the preceding medium M1 in the second direction Y2 passes through the second discharge roller pair 53. It is preferable that this timing is a timing when the leading end of the following medium M2 enters the second discharge roller pair 53 in the nipping position (the nip position) immediately after the second discharge roller pair 53 is switched from reverse rotation to forward rotation after the trailing end of the preceding medium M1 in the second direction Y2 passes through the second discharge roller pair 53.

Next, an operation of the recording apparatus 11 will be described. The controller 100 receives the printing data PD from the host device 200. The controller 100 acquires information on a medium size, the type of the medium (a medium type), whether or not to perform the double-sided printing (the double-sided printing or the single-sided printing), a color of the printing (a color or a grayscale), printing quality (normal printing or high definition printing), and the number of printed sheets, based on the printing condition information of the printing data PD. When the medium M is A3 format exceeding a predetermined size, and the double-sided printing on a plurality of sheets is instructed, the one-sheet circulation transport system is set in which the double-sided printing is performed one by one. Meanwhile, when the medium M has a size that is equal to or less then the predetermined size, for example, A4 format or less, and the double-sided printing on a plurality of sheets is instructed, the two-sheet circulation transport method is set. Further, when the two-sheet circulation transport method is set, the determination unit 110 selects one of the first transport control and the second transport control based on a result of the determination of the ejection amount of the ink.

Hereinafter, the transport control and the printing control by the controller 100 will be described while taking, as an example, a case where the double-sided printing is performed on the medium M having a medium size of A4 format or less. In this case, the two-sheet circulation transport method is set. The controller 100 calculates the passing-each-other area of two sheets of the media M1 and M2 transported while crossing each other and passing through the gap between the second discharge roller pair 53 disposed at the separation position and calculates the ejection amount of the ink in the passing-each-other area of the media M1 and M2, based on the printing condition information and the printing image data. The controller 100 calculates the discharge amount of the ink based on the pixel value of the printing image data in the calculated passing-each-other area, and calculates the average ejection amount in the passing-each-other area by dividing the discharge amount of the ink by the area of the passing-each-other area.

The determination unit 110 determines whether or not the average ejection amount of the passing-each-other area of at least one of the two sheets of media M1 and M2 exceeds the threshold. The controller 100 sets the first transport control when the average ejection amount is equal to or less than the threshold from a result of the determination by the determination unit 110. Meanwhile, the controller 100 performs the second transport control when the average ejection amount exceeds the threshold from a result of the determination by the determination unit 110. The second transport control may be selected when both the average ejection amounts of the passing-each-other area of the two sheets of media M1 and M2 exceed the threshold.

First, the first transport control performed when the recording apparatus 11 performs the double-sided printing on a plurality of the media M having a medium size of A4 format or less will be described with reference to FIG. 2 and FIGS. 5 to 9. As illustrated in FIG. 2, in a stage before the printing starts, the flap 65 is disposed at the first position indicated by the solid line in FIG. 2 which is retracted downward with respect to the first transport path K1 and can be guided the medium M toward the second discharge roller pair 53. The feeding roller 41 performs forward rotation driving from a state illustrated in FIG. 2, so that the preceding medium M1 is fed from the cassette 21 in a feeding direction, and the fed preceding medium M1 is fed along an outer periphery of the intermediate roller 42, and is then nipped to the first transport roller pair 51 performing forward rotation in the first direction Y1. Accordingly, the preceding medium M1 is disposed at the printing start position, and printing starts from the printing start position.

Figure 5:
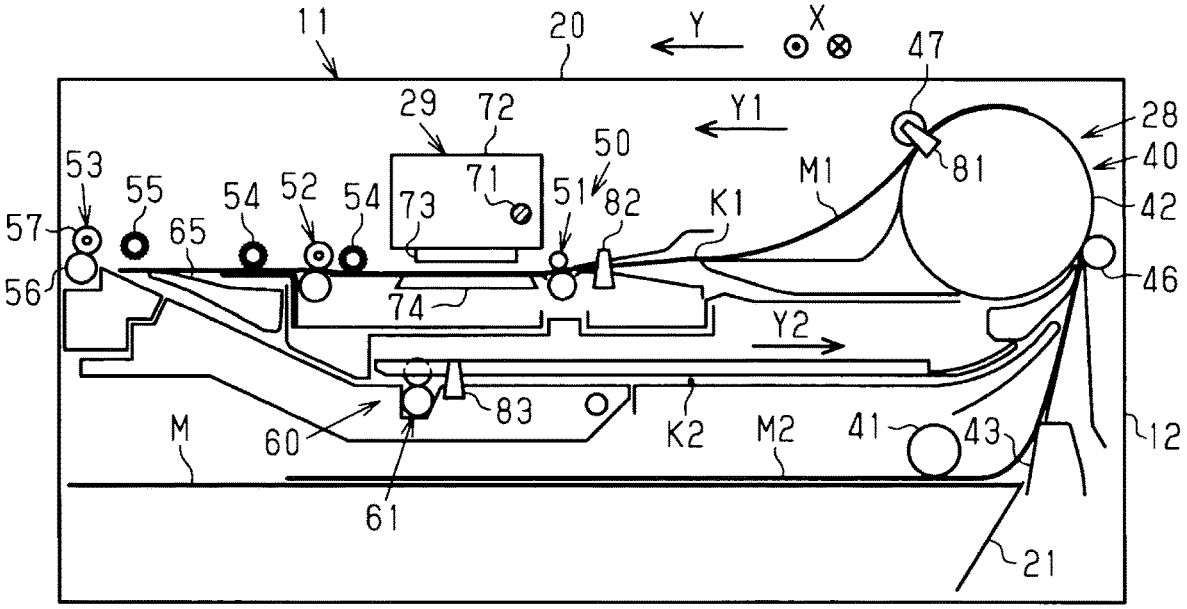
FIG. 5 is a schematic side sectional view for illustrating transport control of a medium when the recording apparatus performs duplex printing.

As illustrated in FIG. 5, the preceding medium M1 being printed is transported while being nipped to the first transport roller pair 51 and the first discharge roller pair 52 at two points. During the printing, a recording operation in which while the carriage 72 moves once in the scanning direction X, the recording head 73 discharges an ink to perform recording on the preceding medium M1 by one scanning and a transport operation in which the preceding medium M1 is transported to a next recording position are alternately performed, printing is performed on the first surface of the preceding medium M1 by the recording unit 29. As the printing is progressed, the preceding medium M1 is eventually supported on the flap 65 located at the first position, is guided by the second discharge roller pair 53, and is nipped to the second discharge roller pair 53. Further, when the trailing end of the preceding medium M1 reaches a predetermined position in the middle of the intermediate roller 42, the following medium M2 waiting at the standby position before the first nip position by the forward rotation driving of the feeding roller 41 is fed to a position spaced apart from the preceding medium M1 by a predetermined distance by causing both the feeding roller 41 and the intermediate roller 42 to perform the forward rotation driving. Thereafter, when the preceding medium M1 is transported while the printing is performed thereon, the following medium M2 is also transported while keeping a predetermined distance from the preceding medium M1.

Figure 6:
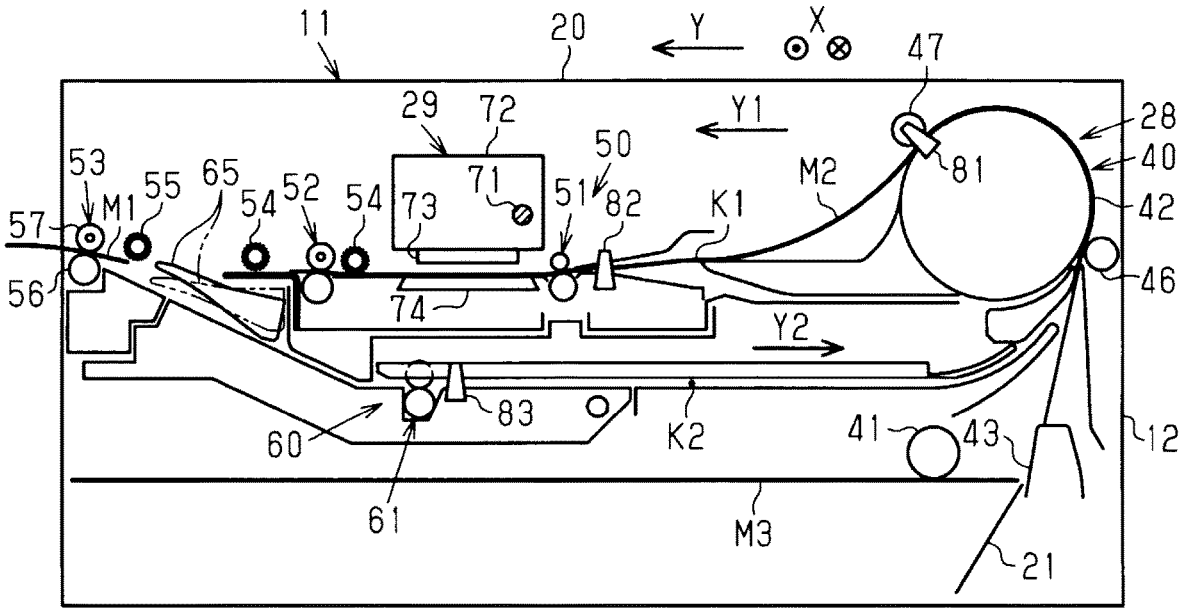
FIG. 6 is the same schematic side sectional view.

The preceding medium M1 of which the printing on the first surface is completed is discharged in the first direction Y1 by the forward rotation driving of the first discharge roller pair 52 and the second discharge roller pair 53. Thus, as illustrated in FIG. 6, when a trailing end of the preceding medium M1 passes through the flap 65, the flap 65 pivots from the first position indicated by a two-dot chain line of FIG. 6 to the second position indicated by a solid line, and the second discharge roller pair 53 is switched from forward rotation to reverse rotation, so that the preceding medium M1 is reversely transported from the position illustrated in FIG. 6 in the second direction Y2. Accordingly, the preceding medium M1 is switched back. The preceding medium M1 transported by the switchback in the second direction Y2 is guided to the lower side by the flap 65 located at the second position and is transported on the second transport path K2 in the second direction Y2. When the switchback operation of the preceding medium M1 is performed, the following medium M2 is already in printing, the printing on the first surface of the following medium M2 by the recording unit 29 is progressed, and the leading end of the following medium M2 is located near the flap 65.

As illustrated in FIG. 7, at a time point when the leading end of the preceding medium M1 in the second direction Y2 is guided to the lower side by the flap 65, the flap 65 pivots from the second position indicated by a two-dot chain line of FIG. 7 to the first position indicated by a solid line of the same drawing. After the trailing end of the preceding medium M1 in the second direction Y2 passes through the second discharge roller pair 53, the preceding medium M1 is transported in the second direction Y2 on the second transport path K2 by the second transport roller pair 61, and for example, stands by at the standby position before the first nip position. After the printing on the following medium M2 is continued, and the trailing end of the preceding medium M1 in the second direction Y2 passes through the second discharge roller pair 53, the following medium M2 is nipped to the second discharge roller pair 53 and is transported in the first direction Y1.

Figure 8:
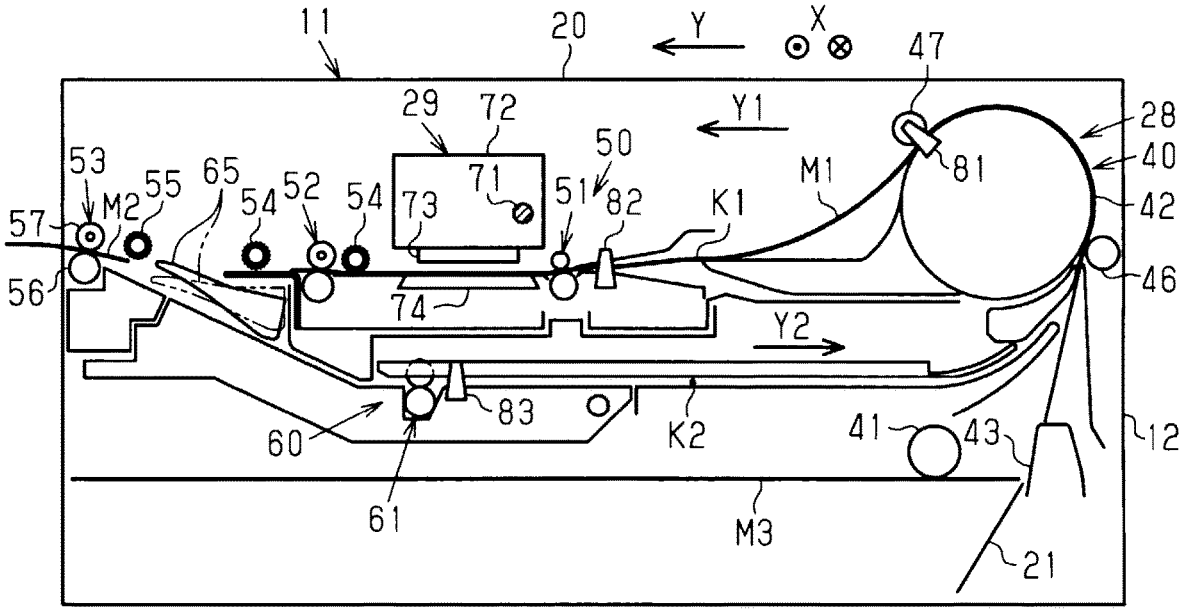
FIG. 8 is the same schematic side sectional view.

Next, as illustrated in FIG. 8, the following medium M2 of which the printing on the first surface is terminated is discharged on the first transport path K1 in the first direction Y1. Thus, when a trailing end of the following medium M2 passes through the flap 65, the flap 65 pivots from the first position indicated by a two-dot chain line of FIG. 8 to the second position indicated by a solid line of the same drawing, and the second discharge roller pair 53 is switched from forward rotation to reverse rotation, so that the following medium M2 is reversely transported from the position illustrated in FIG. 8 in the second direction Y2. Accordingly, the following medium M2 is switched back. The following medium M2 transported by the switchback in the second direction Y2 is guided to the lower side by the flap 65 located at the second position and is transported on the second transport path K2 in the second direction Y2. When the switchback operation of the following medium M2 is performed, the preceding medium M1 already re-fed along the intermediate roller 42 while being reversed is in printing, the printing on the second surface of the preceding medium M1 by the recording unit 29 is progressed, and the leading end of the preceding medium M1 is located near the flap 65.

Figure 9:
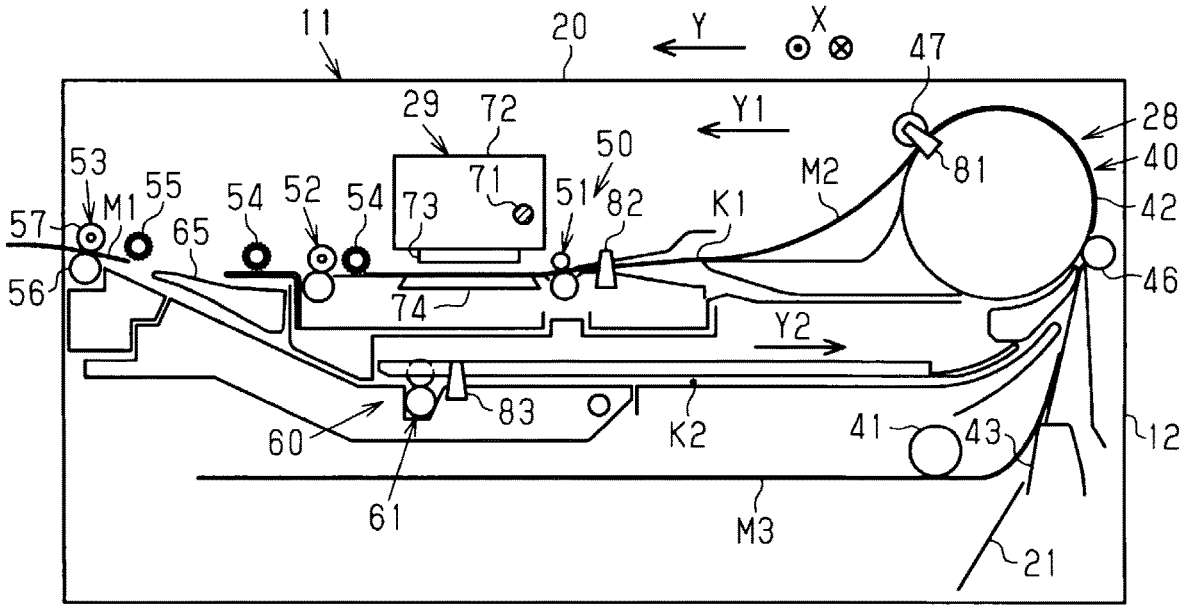
FIG. 9 is the same schematic side sectional view.

Thus, as illustrated in FIG. 9, the preceding medium M1 of which the printing of the second surface is terminated is discharged on the first transport path K1 in the first direction Y1, and the following medium M2 reversed and re-fed along the intermediate roller 42 from the second transport path K2 is transported on the first transport path K1 in the first direction Y1, so that the printing on the second surface is performed. In this way, the preceding medium M1 and the following medium M2 are circulated and transported along the circulation path including the two transport paths K1 and K2, so that the printing on the first surfaces of the two media M1 and M2 and the printing on the second surfaces of the two media M1 and M2 are performed at a high speed. As illustrated in FIG. 9, feeding of the following medium M3 is started during the printing on the following medium M2.

Here, when an average ejection amount of the ink is equal to or less than a threshold, until a timing at which the other medium M2 when the preceding medium M1 is switched back completes the switchback operation and the second discharge roller pair 53 can be switched from the reverse rotation to the forward rotation is reached, the other medium M2 stands by when being transported to a predetermined position on the upper surface of the flap 65. Thus, when the trailing end of the preceding medium M1 in the second direction Y2 passes through the second discharge roller pair 53, the second discharge roller pair 53 is switched from the reverse rotation to the forward rotation, and the printing on the following medium M2 is resumed. Meanwhile, when the average ejection amount of the ink exceeds the threshold, the transport (the reverse transport) of the preceding medium M1 in the second direction Y2 and the passing-each-other transport in which the preceding medium M1 and the following medium M2 cross each other through the gap between the second discharge roller pair 53 disposed at the separation position by the transport of the following medium M2 in the first direction by the printing are performed during the switchback operation.

Next, the first transport control with the passing-each-other transport accompanied will be described with reference to FIGS. 10 to 14. In the passing-each-other transport, when the preceding medium M1 is switched back, there are two execution timings when the following medium M2 is switched back. However, since the transport control is not changed just by replacing the preceding medium M1 and the following medium M2, an example of the former will be described below.

Figure 10:
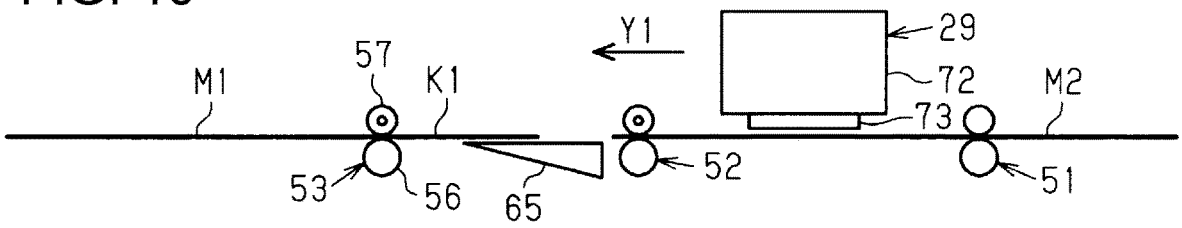
FIG. 10 is a schematic side sectional view for illustrating an important part for illustrating the transport control of the recording apparatus.

As illustrated in FIG. 10, when the printing on the preceding medium M1 is completed, the preceding medium M1 is transported in the first direction Y1. At this time, the flap 65 supports the preceding medium M1 at the first position (the retraction position). Further, the preceding medium M1 is discharged, and the printing on the following medium M2 is started. When the trailing end of the preceding medium M1 in the first direction Y1 passes through the flap 65 (see FIG. 6), the flap 65 rotates from the first position to the second position, and the second discharge roller pair 53 is switched from the forward rotation to the reverse rotation.

Figure 11:
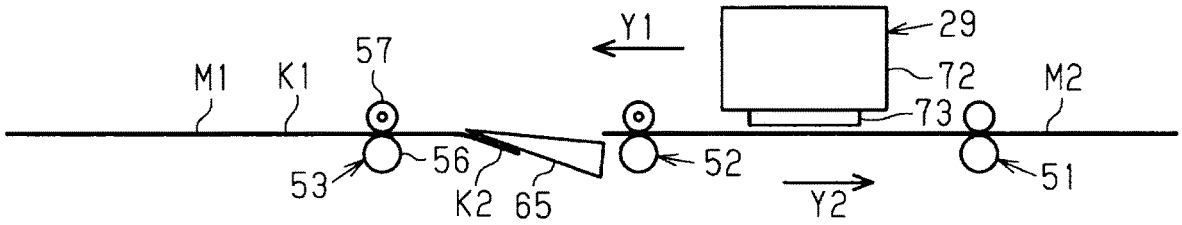
FIG. 11 is the same schematic side sectional view illustrating the important part.

As illustrated in FIG. 11, the second discharge roller pair 53 is switched from the forward rotation to the reverse rotation, the leading end of the switched back preceding medium M1 in the second direction Y2 is guided to the lower side by the flap 65 disposed at the second position. At this time, the following medium M2 stands by before the flap 65. However, when the following medium M2 does not reach a standby position before the flap 65, the printing continues until the following medium M2 reaches the standby position. Here, in a state in which the flap 65 is located at the second position, when the following medium M2 is transported on the flap 65, the following medium M2 supported on the flap 65 is guided obliquely upward on the first transport path K1. Thus, the following medium M2 may not be guided to the second discharge roller pair 53. Therefore, when the flap 65 is located at the second position, the following medium M2 does not pass over the flap 65.

Figure 12:
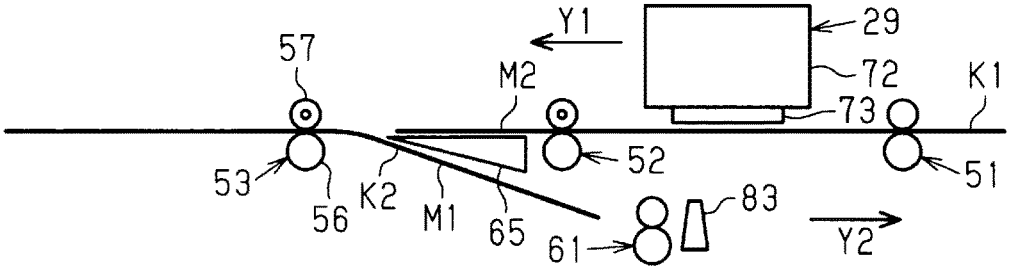
FIG. 12 is the same schematic side sectional view illustrating the important part.

As illustrated in FIG. 12, when the leading end of the preceding medium M1 in the second direction Y2 is guided to the second transport path K2, the controller 100 returns the flap 65 from the second position to the first position. Thereafter, the following medium M2 is supported by the flap 65 located in the first position and is transported in the first direction Y1. Therefore, the following medium M2 is guided to the second discharge roller pair 53. When the following medium M2 stands by before the flap 65, the printing on the following medium M2 is restarted. When the following medium M2 does not stand by, after the flap 65 returns to the first position, the printing on the following medium M2 continues as it is.

Figure 13:
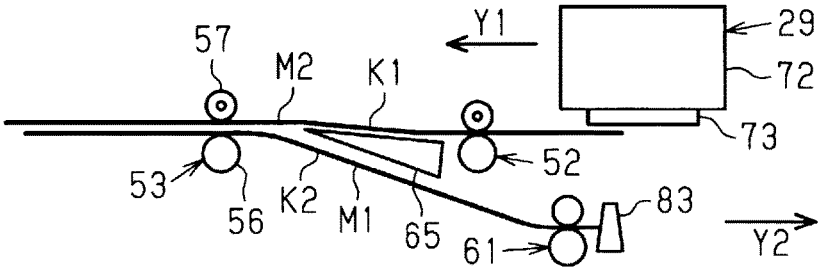
FIG. 13 is the same schematic side sectional view illustrating the important part.

As illustrated in FIG. 13, when the leading end of the preceding medium M1 transported on the second transport path K2 in the second direction Y2 starts to be transported by the second transport mechanism 60, the second discharge roller pair 53 is disposed at the separation position. That is, the leading end of the preceding medium M1 in the second direction Y2 reaches and is nipped to the second transport roller pair 61, and the second discharge roller pair 53 is disposed from the nipping position to the separation position. In the present example, as illustrated in FIG. 13, when the third sensor 83 detects that the leading end of the preceding medium M1 in the second direction Y2 is nipped to the second transport roller pair 61, the second discharge roller pair 53 is driven from the nipping position to the separation position. That is, as the electric motor 91 illustrated in FIG. 4 is driven, the driven roller 57 moves from the lowered position indicated by the solid line in FIG. 4 to the raised position indicated by the two-dot chain line in FIG. 4. Further, almost at the same time, as illustrated in FIG. 13, the flap 65 pivots from the first position to the second position. Therefore, the flap 65 is pushed up in a direction in which the following medium M2 is separated from the preceding medium M1. A timing at which the flap 65 pivots from the first position to the second position may be after a leading end of the following medium M2 has reached the guidable position where guidance to the second discharge roller pair 53 is possible. For example, in the configuration illustrated in FIG. 2, the timing may be after the leading end of the following medium M2 has reached a position of the floating roller 55. Further, the fact that the leading end of the preceding medium M1 in the second direction Y2 reaches and is nipped to the second transport roller pair 61 may be determined based on the transport position of the leading end of the preceding medium M1 managed by a count value of the first counter 111 by the controller 100.

As illustrated in FIG. 13, the transport of the preceding medium M1 in the second direction Y2 according to the switchback operation and the transport of the following medium M2 in the first direction Y1 according to the printing are simultaneously performed through a gap formed by disposing the second discharge roller pair 53 at the separation position. Accordingly, the passing-each-other transport is performed in which the preceding medium M1 and the following medium M2 are transported in opposite directions to each other through the gap between the second discharge roller pair 53. Due to the passing-each-other of the preceding medium M1 and the following medium M2, since the following medium M2 does not need to stand by until the switchback operation of the preceding medium M1 is completed, and the printing on the following medium M2 can continue even in the switchback operation, a standby time of the following medium M2 can be shortened. Therefore, the double-sided printing on a plurality of media can be performed at a high speed.

At this time, since the flap 65 disposed at the second position pushes the following medium M2 up, the following medium M2 in the gap between the second discharge roller pair 53 located at the separation position receives a force in a direction to be separated from the preceding medium M1, as compared to a case where the flap 65 is disposed at the first position. As a result, as the flap 65 is located at the second position, the preceding medium M1 and the following medium M2 are separated more from each other, as compared to a case where the flap 65 is located at the first position. However, even if the preceding medium and the following medium M2 comes into contact with each other, the degree of contact is lightened. Further, even when the preceding medium M1 and the following medium M2 come into contact with each other on the passing-each-other area, since the ejection amount of the ink in the passing-each-other area is equal to or less than the threshold, it is possible to suppress an influence caused by rubbing against a printing surface to a small extent, as compared to a case where the ejection amount exceeds the threshold. Thus, a reduction in printing quality of the media M1 and M2, caused by rubbing at a time of the passing-each-other transport, is suppressed. Further, it is possible to reduce occurrence of a jam caused by breakage of ends portions of the media M1 and M2.

Figure 14:
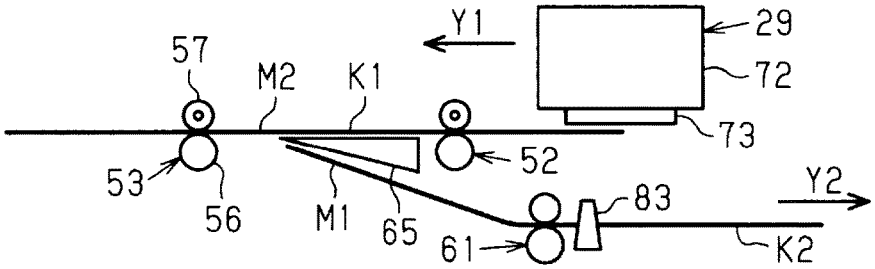
FIG. 14 is the same schematic side sectional view illustrating the important part.

As illustrated in FIG. 14, when the trailing end of the preceding medium M1 transported on the second transport path K2 in the second direction Y2 passes through the nipping position of the second discharge roller pair 53, and reaches the position of the leading end of the flap 65, the controller 100 disposes the second discharge roller pair 53 from the separation position to the nipping position to nip the following medium M2 and causes the second discharge roller pair 53 to perform the forward rotation in accordance with the printing of the following medium M2. Further, almost at the same time, the controller 100 pivots the flap 65 from the second position to the first position. The following medium M2 is guided on the first transport path K1 supported on the flap 65 disposed at the first position and is transported in the first direction Y1 by the second discharge roller pair 53 performing the forward rotation depending on a transport operation during the printing.

Further, even when the printing on the first surface of the following medium M2 is terminated and switched back, in FIGS. 10 to 14, the same transport control is performed merely by replacing the preceding medium M1 and the following medium M2. That is, the second discharge roller pair 53 is disposed at the separation position and the flap 65 is disposed at the second position. Thus, in a state in which the preceding medium M1 is pushed up by the flap 65, the following medium M2 and the preceding medium M1 are transported while passing through each other through a separated gap between the second discharge roller pair 53. Therefore, printing quality due to rubbing of the media M1 and M2 transported while passing through each other can deteriorate and occurrence of a jam caused by breakage of end portions of the media M1 and M2 can be reduced.

In the case of even-numbered sheets of double-sided printing, since a set of two sheets is circulated and transported along the transport paths K1 and K2, all the even-numbered sheets of media M are reversed through the second transport path K2. However, in the case of odd-numbered sheets of double-sided printing, the double-sided printing is performed on the last one sheet. Thus, after the switchback operation, the first transport path K1 and the reverse passage 64 are reversely transported and reversed. At this time, since the length of a path passing through the first transport path K1 and the reverse passage 64 is shorter than the length of a path of the second transport path K2, after the printing on the first surface is terminated, the printing on the second surface can be started early with a short reversal distance. From this point, the odd-numbered sheets of the double-sided printing can be performed at a high speed.

Meanwhile, when the average ejection amount exceeds the threshold, the controller 100 sets the second transport control. In this case, in a process in which the preceding medium M1 is switched back, the following medium M2 stands by before the flap 65, at a time point when the trailing end of the preceding medium M1 in the second direction Y2 passes through the second discharge roller pair 53 located at the nipping position, the printing on the following medium M2 that has stood by is resumed. At this time, the second discharge roller pair 53 that has been reversed for the switchback operation of the preceding medium M1 performs the forward rotation after the switchback operation is terminated. After the forward rotation, the leading end of the following medium M2 is nipped to the second discharge roller pair 53. Meanwhile, in a process of switching back the following medium M2, the same transport control is performed by replacing the preceding medium M1 and the following medium M2.

Further, when the double-sided printing is performed on the plurality of media M having a size of A3, the one-sheet circulation transport method is set, and the double-sided printing is performed in which the medium M is circulated and transported one by one. That is, after the printing is performed on the first surface of the first medium M, the medium M is reversed after being transported on the second transport path K2 with the switchback operation being accompanied. After the reverse, the printing is performed on the second surface, and the medium M is discharged. This is also performed for the second and subsequent media M one by one. When the one-sheet circulation transport method is set, for example, when the double-sided printing is performed on the medium M, a transport path through which the medium M is reversed after the switchback operation may be the first transport path K1 and the reverse passage 64 having a reverse path length that is shorter than the second transport path K2.

Further, even in the case of the face-down discharge in which the single-sided printing is performed on the plurality of media M and the media M are discharged while a printed surface faces the lower side, similarly to the plurality of sheets of the double-sided printing, the transport control is performed in the two-sheet circulation transport method through the two transport paths K1 and K2 with the switchback operation accompanied, so that the face-down discharge can be performed at a high speed during the single-sided printing. That is, after the printing is performed on the first surface of the preceding medium M1, after the preceding medium M1 is switched back and is transported in the second direction Y2 through the second transport path K2, the preceding medium M1 is reversed and re-fed by the intermediate roller 42, and the re-fed preceding medium M1 is discharged through the first transport path K1 as it is. Since this is performed by circulating and transporting the two media M1 and M2, the single-sided printing on the plurality of facedown-discharged sheets can be performed at a high speed.

Further, the feeding of the following medium M2 starts during the printing on the preceding medium M1, and the preceding medium M1 and the following medium M2 are transported together at a predetermined interval. When the printing on the preceding medium M1 is completed, the heading of the following medium M2 to a printing start position is performed together with the discharge. Therefore, a time interval from the start of discharge of the preceding medium M1 to the start of printing of the following medium M2 is shortened. From this point as well, the double-sided printing and the single-sided printing are performed at a high speed.

In the present embodiment, at a time of the single-sided printing on a dedicated medium such as a glossy medium on which an image requiring high quality such as photograph printing is printed, until the trailing end of the medium M transported on the first transport path K1 passes through the first discharge roller pair 52, the second discharge roller pair 53 may be disposed at the separation position. With this configuration, until the medium M passes through the first discharge roller pair 52, the medium M is transported or discharged by the first discharge roller pair 52. Thus, during this time, since the medium M is not nipped to the second discharge roller pair 53, a roller mark is less likely to be formed on the printing surface of the medium M. In particular, the driven rollers 52B and 57 of the discharge roller pairs 52 and 53 are often toothed rollers (gear rollers) having teeth on an outer circumference thereof. Since a time for separation from the driven roller 57 is long, a mark of the teeth of the roller hardly sticks to the printing surface of the medium M. Immediately before the trailing end of the medium M passes through the first discharge roller pair 52, the second discharge roller pair 53 is disposed from the separation position to the nipping position. Therefore, after the trailing end of the medium M passes through the first discharge roller pair 52, the medium M can be transported by the second discharge roller pair 53.

In the short medium M of which one sheet is printed and which has a medium length of a predetermined size or less, when the ejection amount of the ink is equal to or less than the threshold, the medium is reversely transported and reversed through a passage passing through the first transport path K1 and the reverse passage 64 passing through a gap between the support 74 and the recording head 73. Meanwhile, in the short medium M of which one sheet is printed and which has a medium length of a predetermined size or less, when the ejection amount of the ink exceeds the threshold, when the medium M is reversely transported and reversed through the first transport path K1, since the medium M rubs against the recording head 73 due to curling of the medium M that is likely to occur after recording, the medium M may be reversed through the second transport path K2.

According to the above embodiment, the following effects can be obtained.

(1) The recording unit 29 that discharges an ink to the medium M and performs recording is included. Further, the recording apparatus 11 includes the first transport path K1 through which the medium M is transported in the first direction Y1 during the recording by the recording unit 29 and the second transport path K2 which is connected to the first transport path K1 located at a downstream position of the recording unit 29 in the first direction Y1 and through which the medium M recorded by the recording unit 29 is transported through a passage that is different from the first transport path K1 in the second direction Y2 that is different from the first direction Y1. Further, the recording apparatus 11 includes the second discharge roller pair 53 that provides a transport force in the first direction Y1 and the second direction Y2 to the medium M at a downstream position of the recording unit 29 in the first direction Y1, and that can be displaced between the nipping position where the medium M can be transported while being nipped and a separation position separated from the nipping position. The recording apparatus 11 includes the flap 65 as an example of a variable member the is disposed downstream of the recording unit 29 in the first direction Y1, and that can be displaced between the second position (the advanced position) where the flap 65 is advanced to the first transport path K1 and the first position (the retraction position) where the flap 65 is retracted from the first transport path K1 from the second position. The preceding medium M1 is transported to the first transport path K1 and the following medium M2 is transported to the second transport path K2. When the media M1 and M2 are simultaneously disposed at a position of the second discharge roller pair 53, the second discharge roller pair 53 is disposed at the separation position and the flap 65 is disposed at the second position.

Thus, in a gap formed by disposing the second discharge roller pair 53 at the separation position, the preceding medium M1 and the following medium M2 can be transported in opposite directions. Moreover, as the flap 65 is advanced to the first transport path K1 side, a force acts in a direction to separate the two media M1 and M2 from each other. Therefore, when the preceding medium M1 and the following medium M2 pass through the gap between the second discharge roller pair 53 disposed at the separation position, the two media M1 and M2 can be separated from each other. However, even though the preceding medium M1 and the following medium M2 come into contact with each other, contact resistance therebetween can be kept low. Thus, it is possible to reduce or eliminate inconvenience caused as the two media M1 and M2 transported in opposite directions at the same time rub against each other through the gap between the second discharge roller pair 53 disposed at the separation position.

(2) The flap 65 is used as an example of a variable member. The flap 65 is disposed at a position where the medium M transported on the first transport path K1 at the first position (the retraction position) is supported to face the second discharge roller pair 53, and is disposed at a position where the medium M is fed to the second transport path K2 at the second position (the advanced position). Thus, as the position of the flap 65 is controlled, the medium M can be guided and a transport direction of the medium M can be controlled. When the flap 65 is located at the first position, the medium M can be guided to the second discharge roller pair 53. When the flap 65 is located at the second position, in a process of passing through the gap between the second discharge roller pair 53 located at the separation position, it is possible to avoid or alleviate contact between the preceding medium M1 and the following medium M2.

(3) There is a reverse path that joins the second transport path K2 to the first transport path K1 at an upstream position of the recording unit 29 in the first direction Y1. Thus, the medium M transported through the second transport path K2 after the first surface (the single surface) is recorded is sent from a joining point with the first transport path K1 to the first transport path K1, is reversed, and is fed again, so that the double-sided printing can be performed in which the printing is performed on the second surface that is opposite to the recorded first surface (a recorded surface) of the medium M.

(4) The flap 65 is advanced from a surface opposite to a surface recorded by the recording unit 29 toward the first transport path K1. Thus, when the flap 65 is disposed at the second position (the advanced position), the medium M is pressed from a surface opposite to a printed surface (a printing surface). Thus, even when the flap 65 comes into contact with the medium M, deterioration in quality due to rubbing on the printed surface immediately after the printing is not caused.

(5) The recording apparatus 11 includes a first transport mechanism 50 that transports the medium M in the first direction Y1 on the first transport path K1 in a region including a region opposite to the recording unit 29 and a second transport mechanism 60 that transports the medium M on the second transport path K2 in the second direction Y2. Thus, even when the second discharge roller pair 53, which is responsible for the transport of the medium M in the first direction Y1 and the transport of the medium M in the second direction Y2, is disposed at the separation position, the following medium M2 can be transported by the first transport mechanism 50, and the preceding medium M1 can be transported by the second transport mechanism 60.

(6) When the trailing end of the preceding medium M1 transported on the first transport path K1 in the first direction Y1 passes through a position of the flap 65, the flap 65 is disposed at the second position (the advanced position), and the second discharge roller pair 53 is reversely rotated to transport the preceding medium M1 in the second transport path K2. When the leading end of the preceding medium M1 transported on the second transport path K2 in the second direction Y2 starts to be transported by the second transport mechanism 60, the second discharge roller pair 53 is disposed at the separation position. When the trailing end of the preceding medium M1 transported on the second transport path K2 in the second direction Y2 passes through the position of the flap 65, the flap 65 is disposed at the first position (the retraction position), and the second discharge roller pair 53 is disposed at the nipping position and performs the forward rotation to transport the following medium M2 in the first direction Y1. Thus, since the flap 65 is disposed at the second position when the trailing end of the preceding medium M1 in the first direction Y1 passes through the flap 65, thereafter, even when the preceding medium M1 is reversely transported, the reversely transported preceding medium M1 can be guided to the second transport path K2. Further, when the preceding medium M1 guided to the second transport path K2 starts to be transported by the second transport mechanism 60, since the second discharge roller pair 53 is disposed at the separation position, even when the second discharge roller pair 53 is disposed at the separation position, the preceding medium M1 can be transported on the second transport path K2. Further, when the trailing end of the preceding medium M1 in the second direction Y2 passes through the position of the flap 65, the flap 65 is disposed at the first position, and the second discharge roller pair 53 is disposed at the nipping position and performs the forward rotation to transport the following medium M2 in the first direction Y1. Thus, it is possible to reduce inconvenience caused by the rubbing of the two media M1 and M2 simultaneously transported in opposite directions through the gap between the second discharge roller pair 53. At a timing at which the flap 65 is disposed at the first position and the second discharge roller pair 53 is disposed at the nipping position, the trailing end of the preceding medium M1 in the second direction Y2 may be located at a position the trailing end passes through a position of a leading end of the flap 65.

(7) When a discharge amount of an ink discharged onto the medium M by the recording unit 29, that is, the ejection amount is equal to or less than the threshold, in a period in which the medium M transported to the first transport path K1 and the second transport path K2 is simultaneously disposed at the position of the second discharge roller pair 53, control is performed in which the second discharge roller pair 53 is disposed at the separation position and the flap 65 is disposed at the second position (the advanced position).

Thus, when the ejection amount of the ink is equal to or less than the threshold, the passing-each-other transport is performed in which the two sheets of the media M1 and M2 are simultaneously transported through the gap between the second discharge roller pair 53 located at the separation position in opposite directions. Meanwhile, when the ejection amount of the ink exceeds the threshold, the passing-each-other transport is not performed in which the two sheets of the media M1 and M2 are simultaneously transported through the gap between the second discharge roller pair 53 located at the separation position in opposite directions. That is, when the ejection amount of the ink exceeds the threshold, the two sheets of media M1 and M2 are transported one by one by the second discharge roller pair 53 located at the nipping position. Therefore, the ejection amount of the ink exceeds the threshold, the amount of an ink adhering to the medium M relatively increases, and occurrence of inconvenience such as a jam and a reduction in printing quality caused by an increase in a contact load at a time of the passing-each-other caused by curling or the like of the media M1 and M2.

(8) The first transport mechanism 50 includes other roller pairs 51 and 52 other than the second discharge roller pair 53 for transporting the medium M. When the type of the medium M is a second medium type (for example, a dedicated medium such as glossy paper) which is recorded with a higher quality than the first medium type (for example, a plain paper), even in the single-sided printing, the second discharge roller pair 53 is disposed at the separation position in a period during which the medium M can be transported by the other roller pairs 51 and 52. Thus, it is possible to reduce a roller mark that is attached to the medium M that is the second medium type by being held by the second discharge roller pair 53.

Second Embodiment

Figure 16:
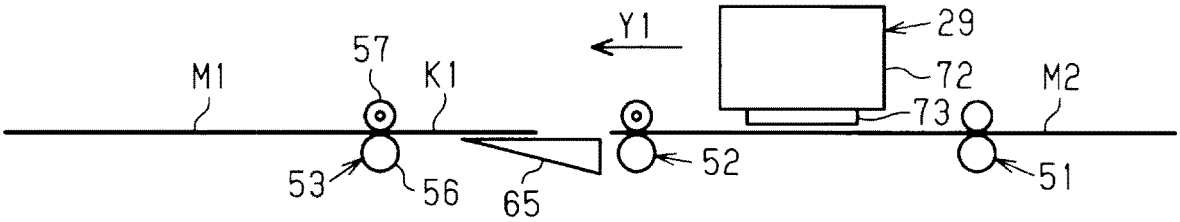
FIG. 16 is a schematic side sectional view for illustrating an important part for illustrating the transport control of the recording apparatus according to a second embodiment.
Figure 17:
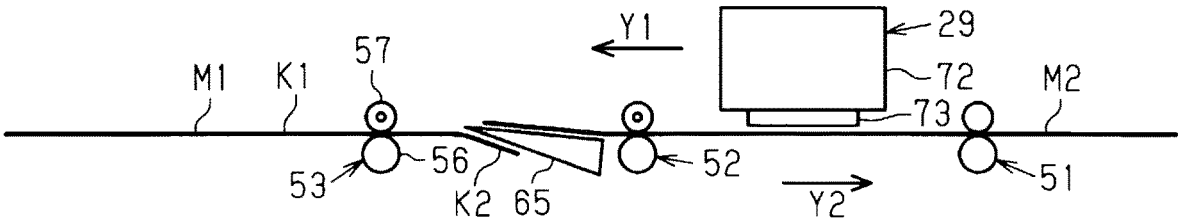
FIG. 17 is the same schematic side sectional view illustrating the important part.
Figure 18:
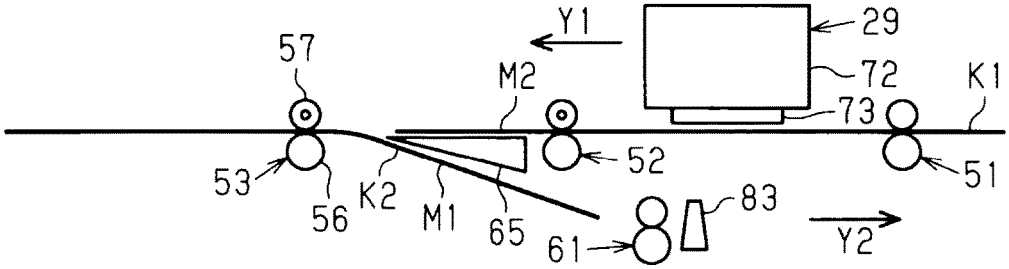
FIG. 18 is the same schematic side sectional view illustrating the important part.
Figure 19:
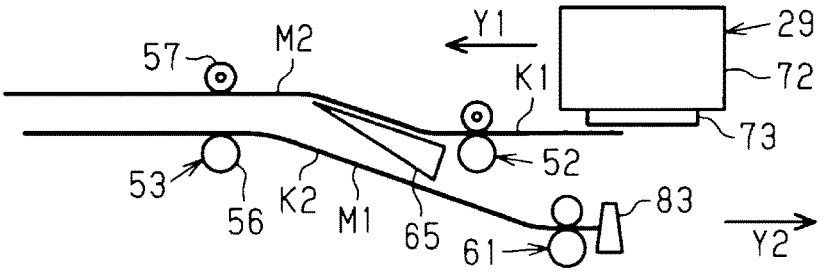
FIG. 19 is the same schematic side sectional view illustrating the important part.
Figure 20:
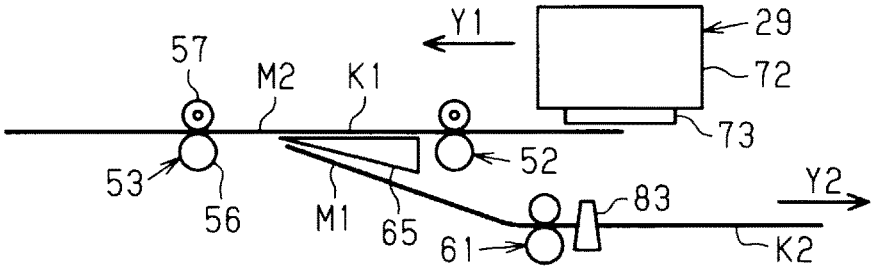
FIG. 20 is the same schematic side sectional view illustrating the important part.

Next, a second embodiment will be described with reference to FIGS. 16 to 20. The second embodiment differs from the first embodiment in terms of a method of controlling the flap 65. FIGS. 16, 18, and 20 are the same as FIGS. 10, 12, and 14 in the first embodiment. FIGS. 17 and 19 are different from the corresponding drawing according to the first embodiment.

In FIG. 16, the flap 65 is disposed at the first position (the retraction position), supports the preceding medium M1, and guides the preceding medium M1 to the second discharge roller pair 53.

In FIG. 17, when the trailing end of the preceding medium M1 in the first direction Y1 passes through the flap 65, the controller 100 pivots the flap 65 to the second position (the advanced position). Almost at the same time, the controller 100 switches the second discharge roller pair 53 from the forward rotation to the reverse rotation. Accordingly, the preceding medium M1 is switched back. The leading end of the preceding medium M1 in the second direction Y2 is guided to the second transport path K2 by the flap 65 disposed at the second position. Meanwhile, the following medium M2 continues to be printed without waiting. The following medium M2 waits for a shorter time than in the first embodiment.

In FIG. 18, when the flap 65 guides the leading end of the preceding medium M1 in the second direction to the second transport path K2, the flap 65 returns to the first position to support the following medium M2. Meanwhile, the printing on the following medium M2 continues. When the printing on the following medium M2 is temporarily stopped with a waiting time shorter than that in the first embodiment, the printing is restarted. When the preceding medium M1 is guided to the second transport path K2, an angle of the flap 65 disposed at the second position (the advanced position) is an angle at which the flap 65 supports the following medium M2 to guide the following medium M2 to the second discharge roller pair 53, the flap 65 may be left in the second position.

In FIG. 19, when the leading end of the preceding medium M1 in the second direction Y2 reaches the second transport roller pair 61, the second discharge roller pair 53 is disposed at the separation position. After the leading end of the following medium M2 in the first direction Y1 reaches a guidable position where the leading end can be guided to the second discharge roller pair 53, for example, when the leading end passes through a position between the separated second discharge roller pair 53, the flap 65 pivots to a third position where the flap 65 is advanced further toward the first transport path K1 than the second position (the advanced position). That is, when the leading end of the preceding medium M1 in the second direction Y2 reaches the second transport roller pair 61, and the transport of the preceding medium M1 by the second transport roller pair 61 is started, as the electric motor 91 illustrated in FIG. 4 is driven, the driven roller 57 moves from the lowered position indicated by the solid line of FIG. 4 to the raised position indicated by the two-dot chain line of FIG. 4. At this time, the raised position of the driven roller 57 is higher than the raised position according to the first embodiment. Further, when the leading end of the following medium M2 in the first direction Y1 reaches a position between the separated second discharge roller pair 53, the flap 65 is disposed at the third position where the flap 65 is advanced further than the second position (the advanced position). The reason why the flap 65 is disposed at the third position when the leading end of the following medium M2 in the first direction Y1 reaches the position of the second discharge roller pair 53 is that the leading end of the following medium M2 is prevented from being induced between the separated second discharge roller pair 53 and causing jamming. Although the third sensor 83 detects that the leading end of the preceding medium M1 in the second direction Y2 reaches and is nipped to the second transport roller pair 61, the controller 100 may perform determination based on the transport position of the leading end of the preceding medium M1 managed by a count value of the first counter 111. In FIG. 19, a gap dimension when the second discharge roller pair 53 is disposed at the separation position is longer than a gap dimension of the first embodiment according to an inclination angle of the flap 65 at the third position.

In FIG. 20, when the trailing end of the preceding medium M1 in the second direction Y2 passes through the second discharge roller pair 53 and reaches the position of the leading end of the flap 65, the flap 65 returns from the third position to the first position. Almost at the same time, the second discharge roller pair 53 is disposed from the separation position to the nipping position, and the second discharge roller pair 53 performs the forward rotation in accordance with the printing of the following medium M2. Accordingly, the second discharge roller pair 53 nips the following medium M2 and transports the following medium M2 in the first direction Y1.

Thereafter, in a process in which the following medium M2 is reversed after the printing on the first surface is terminated, the same transport control is performed by the controller 100 merely by replacing the preceding medium M1 and the following medium M2 in FIGS. 16 to 20.

According to the second embodiment, the following effects can be obtained in addition to the effects (1) to (8) according to the first embodiment.

(9) When the leading end of the following medium M2 transported on the first transport path K1 in the first direction Y1 passes through the position between the second discharge roller pair 53 disposed at the separation position, the flap 65 is disposed at the third position further advanced from the second position (the advanced position). Thus, since the flap 65 is further advanced from the second position, when the second discharge roller pair 53 is in the separation position, the following medium M2 may be further pushed up by the flap 65. Therefore, in the passing-each-other transport in which the two media M1 and M2 are transported simultaneously in opposite directions through the gap between the second discharge roller pair 53 in the separation position, it is possible to make the media M1 and M2 further apart from each other or to further reduce a contact load even when the media M1 and M2 come into contact with each other.

The above embodiment can be changed to the following form.

A sensor for detecting whether the leading end of the preceding medium M1 is guided to the second transport path K2 by the flap 65 may be provided below the flap 65. When the sensor detects that the leading end of the medium M in the second direction Y2 is guided to the flap 65, the flap 65 may be lowered from the second position to the first position. In this case, when the flap 65 guides the preceding medium M1 to the second transport path K2, the flap 65 is once lowered to the first position to guide the following medium M2. When the leading end of the following medium M2 reaches the guidable position where the leading end of the following medium M2 is a lower side of the floating roller 55, the flap 65 is disposed at the second position or the third position to push up the following medium M2.

The variable member is not limited to the flap. The variable member may be any member as long as the member can be placed in a direction in which the member can be separated from the preceding medium when the passing-each-other transport is performed by pushing up the following medium.

In the embodiment, the following medium M2 is pushed up to separate the preceding medium M1 from the following medium M2. However, it is also possible to push the preceding medium M1 downward to separate the preceding medium M1 from the following medium M2. In this case, the medium M may be pushed down by a member other than the flap 65.

In the embodiments, the two discharge roller pairs 52 and 53 are provided. However, one discharge roller pair 53 may be provided. In this case, the one discharge roller pair 53 may be disposed at the position of the first discharge roller pair 52 in FIG. 2, and the flap 65 may be disposed on the second direction Y2 side of the discharge roller pair 53.

The first transport mechanism 50 may include at least a part of a transport belt for transporting the medium M.

The second transport path is not limited to the lower path with respect to the first transport path K1 but may be an upper path.

Even in the medium M in which the length of the medium M along the transport direction is twice longer than a path length of a circulation path formed by the first transport path K1 and the second transport path K2, the second discharge roller pair 53 is disposed at the separation position, and the passing-each-other transport may be performed. For example, when the double-sided printing is performed on a plurality of sheets of media M having A3 size, the two-sheet circulation transport with the passing-each-other transport accompanied may be performed.

The recording apparatus is not limited to a multifunction peripheral, and may be a printer dedicated to printing without a scanner mechanism and a copy function.

The recording apparatus may be a line printer employing a line printing method using the recording unit 29. The recording head 73 of the line printing method is a line head having an elongated shape that is slightly longer than the maximum width of the medium in a width direction intersecting the transport direction Y, and performs the printing by discharging an ink corresponding to one line to the medium M transported at a constant speed according to a printing mode.

The controller 100 may be realized by, for example, hardware by an electronic circuit (for example, a semiconductor integrated circuit) such as a field-programmable gate array (FPGA) and an application specific IC (ASIC) in addition to software using a computer that executes a program or may be realized by cooperation between software and hardware.

The medium is not limited to a paper sheet, and may be a synthetic resin film or sheet, a cloth, a nonwoven fabric, a laminate sheet, or the like.

The liquid is not limited to colored ink and may be a transparent ink. Further, the liquid may be a dye ink, a pigmented ink, or a solvent-based ink, or may be an ultraviolet curable ink which is cured by irradiation with ultraviolet rays.

What is claimed is:

1. A recording apparatus comprising:

a recording unit that performs recording by discharging an ink to a recording medium;

a first transport path through which the recording medium is transported in a first direction during the recording by the recording unit;

a second transport path which is connected to the first transport path at a downstream position of the recording unit in the first direction, and through which the recording medium recorded by the recording unit is transported along a path that is different from the first transport path in a second direction that is different from the first direction;

a roller pair that is configured to apply a transport force to the recording medium in the first direction and the second direction at a downstream position of the recording unit in the first direction and that is configured to be displaced between a nipping position where the recording medium is configured to be transported while being nipped and a separation position where it is separated from the nipping position; and a variable member that is disposed downstream of the recording unit in the first direction and is configured to be displaced between a first position and a second position, wherein when at the first position a first end of the variable member supports the medium as it is transported on the first transport path and when at the second position, the first end of the variable member is moved to a location above the first transport path so that the recording medium can be directed beneath the first end of the variable member towards the second transport path, wherein when a following recording medium is transported on the first transport path, a preceding recording medium is transported on the second transport path, and the respective recording media are disposed at a position of the roller pair at the same time, the roller pair is disposed at the separation position, and the variable member is disposed at the second position, and wherein when a discharge amount of a liquid discharged to the recording medium by the recording unit is equal to or less than a threshold, in a period in which the recording media being transported on the first transport path and the second transport path, respectively, are disposed at the position of the roller pair at the same time, control is performed in which the roller pair is disposed at the separation position and the variable member is disposed at the second position.

2. The recording apparatus according to claim 1, wherein the variable member is a flap.

3. The recording apparatus according to claim 1, wherein the second transport path is a reverse path that is joined to the first transport path at an upstream position of the recording unit in the first direction.

4. The recording apparatus according to claim 1, wherein the variable member is advanced from a surface opposite to a surface recorded by the recording unit to the first transport path.

5. The recording apparatus according to claim 1, further comprising:

a first transport mechanism that transports the recording medium on the first transport path in the first direction in an area including an area facing the recording unit; and a second transport mechanism that transports the recording medium on the second transport path in the second direction.

6. The recording apparatus according to claim 5, wherein when a trailing end of the preceding recording medium being transported on the first transport path in the first direction passes through a position of the variable member, the variable member is disposed at the second position, and the roller pair is reversely rotated to transport the preceding recording medium on the second transport path, when a leading end of the preceding recording medium being transported on the second transport path in the second direction starts to be transported by the second transport mechanism, the roller pair is disposed at the separation position, and when the trailing end of the preceding recording medium being transported on the second transport path in the second direction passes through the position of the variable member, the variable member is disposed at the first position, and the roller pair is disposed at the nipping position to perform forward rotation so as to transport the following recording medium in the first direction.

7. The recording apparatus according to claim 6, wherein when a leading end of the following recording medium being transported on the first transport path in the first direction passes through a position between the roller pair disposed at the separation position, the variable member is disposed at a position further advanced from the second position.

8. The recording apparatus according to claim 1, further comprising:

the other roller pair for transporting the recording medium other than the roller pair, wherein when a type of the recording medium is a second medium type in which the recording is performed at a higher quality than a first medium type, even in the case of single-sided printing, the roller pair is disposed at the separation position in a period in which the recording medium is configured to be transported by the other roller pair.

* * * * *